US007354233B2

(12) United States Patent
Oki et al.

(10) Patent No.: US 7,354,233 B2
(45) Date of Patent: Apr. 8, 2008

(54) BOOKBINDING MACHINE AND PREBINDING APPARATUS

(75) Inventors: Yutaka Oki, Kanagawa (JP); Masatoshi Takahashi, Kanagawa (JP); Yuichi Misawa, Kanagawa (JP)

(73) Assignee: Duplo Corporation, Sagamihara-Shi, Kanagawa-Ken (JP)

( * ) Notice: Subject to any disclaimer, the term of this patent is extended or adjusted under 35 U.S.C. 154(b) by 604 days.

(21) Appl. No.: 10/984,880

(22) Filed: Nov. 10, 2004

(65) Prior Publication Data

US 2005/0100429 A1 May 12, 2005

(30) Foreign Application Priority Data

Nov. 12, 2003 (JP) ..... 2003-383096

(51) Int. Cl.
*B42B 9/00* (2006.01)

(52) U.S. Cl. ..... 412/16; 412/9; 412/13; 270/52.17; 270/52.14

(58) Field of Classification Search ..... 412/9, 412/11, 13–14, 16, 22, 18, 19, 33; 270/52.14, 270/58.04, 52.17, 58.07, 37, 52.18, 52.15, 270/58.08, 58.09; 83/934, 76.8, 367, 76.9
See application file for complete search history.

(56) References Cited

U.S. PATENT DOCUMENTS 4,621,757 A * 11/1986 Osako ..... 227/1
5,601,389 A * 2/1997 Minami ..... 412/14
6,685,416 B2 * 2/2004 Itoh et al. ..... 412/37
6,729,612 B2 * 5/2004 Nagao et al. ..... 270/37
7,137,625 B2 * 11/2006 Yamada et al. ..... 270/58.07
2001/0019191 A1 * 9/2001 Yoshie et al. ..... 270/52.17
2001/0054342 A1 * 12/2001 Kato et al. ..... 83/78
2002/0060388 A1 * 5/2002 Wakabayashi et al. ... 270/58.08

FOREIGN PATENT DOCUMENTS

EP 1531060 A2 * 5/2005
JP 10-146796 6/1998
JP 2000-34052 2/2000
JP 2001-232700 8/2001

OTHER PUBLICATIONS

European Search Report dated Aug. 28, 2006.

* cited by examiner

*Primary Examiner*—Monica Carter
*Assistant Examiner*—Jamila Williams
(74) *Attorney, Agent, or Firm*—McGinn IP Law Group, PLLC

(57) ABSTRACT

In a bookbinding machine, an image forming apparatus, a prebinding apparatus and a bookbinding apparatus are coupled on line in this order. In the prebinding apparatus, a sheet aligning section, a slitting section which cuts off margins at both side portions of a sheet of paper, a cutting section which cuts off top and bottom margins, and a creasing section are arranged in this order. The prebinding apparatus is provided with a control section which sorts out supplied sheets of paper into those which need an SCC step and those which do not, and performs the SCC step only on the sheets of paper that need the SCC step.

16 Claims, 31 Drawing Sheets

BOOKBINDING MACHINE AND PREBINDING APPARATUS

BACKGROUND OF THE INVENTION

1. Field of the Invention

The present invention relates to a bookbinding machine which binds sheets of paper having images formed on the top surfaces into a booklet, and a prebinding apparatus which is installed in the bookbinding machine to execute a prebinding process.

2. Description of the Related Art

At a binding state, an image forming process for forming images on top surfaces of sheets of paper using a printing machine, a printer or similar techniques, a prebinding process for cutting edge portions or margins of the sheets of paper having images formed on the top surfaces (hereinafter also called "image-formed sheets of paper") and creasing the image-formed sheets of paper, and a binding process of stacking and connecting the image-formed sheets of paper, undergone the prebinding process, in the order of pages and folding the image-formed sheets of paper along the creases to provide a booklet are carried out in order. The prebinding process includes a step of cutting off the margins at both sides of sheets of paper (slitter step), a step of cutting top and bottom margins of sheets of paper (cutter step) and a step of creasing (creaser step), which are generically called an SCC (Slitter, Cuter and Creaser) step.

The slitter step and the cutter step are needed to remove margins, which are inevitably produced at the time of printing, when performing, for example, full-size printing. When printing is done on a thick sheet of paper such as color print paper, if the sheet is folded directly in the binding process, cracks may occur at the folded portion. The creaser step is needed to prevent the occurrence of cracking. When an image is formed with sufficient margins provided at the peripheral portion of a sheet of paper, therefore, the image can be formed initially on a sheet of paper of the binding size, thus eliminating the slitter step and the cutter step. The creaser step is unnecessary when an image is formed on a thin sheet of paper and no printing is done at the folded portion as in, for example, monochromatic printing.

There is an off-line type of prebinding apparatus which performs the SCC step; for example, a single sheet type apparatus as disclosed in, for example, Japanese Patent Laid-Open Publication No. 2001-232700. There also is a batch type apparatus. In case of binding full-size color print sheets, an image forming apparatus such as a printer forms images on sheets of paper with an extra size greater than the binding size by printing or so, a worker carries the image-formed sheets from the image forming apparatus to a prebinding apparatus, performs the SCC step using the prebinding apparatus, then carries the image-formed sheets from the prebinding apparatus to a bookbinding apparatus to perform the binding process with the bookbinding apparatus.

The prior art however has the following shortcomings. As the prebinding process is conventionally performed off line, carrying sheets of paper between the image forming apparatus and the prebinding apparatus and between the prebinding apparatus and the bookbinding machine is done by a worker. This slows down the processing speed and leads to a lower efficiency. In addition, the prebinding apparatus and the bookbinding apparatus should be operated individually, resulting in a large operational burden and a lower efficiency.

A prebinding apparatus as described in the Japanese Patent Laid-Open Publication No. 2001-232700 may be coupled to the subsequent stage of the image forming apparatus, and a bookbinding machine may be coupled to the subsequent stage of the prebinding apparatus to assemble an on-line bookbinding machine having those apparatuses coupled in the order of the image forming apparatus—prebinding apparatus—bookbinding apparatus. But, such a bookbinding machine performs the SCC step on all of image-formed sheets of paper output from the image forming apparatus. As mentioned above, however, pages of image-formed sheets of paper printed in full size and pages of thick sheets of paper, such as color print sheets, need the SCC step, while pages of thin sheets of paper with margins at the peripheral portions, such as monochromatic print sheets, do not need the SCC step. Booklets with a mixture of pages of thin sheets with margins at the peripheral portions and pages printed in full size are increasing recently. Even when an on-line bookbinding machine is constructed by a simple combination of conventional apparatuses, the machine performs the SCC step even on sheets of paper which do not require the SCC step. This reduces the bookbinding efficiency to the contrary to the purpose of the on-line machine.

SUMMARY OF THE INVENTION

Accordingly, it is an object of the present invention to provide a bookbinding machine which relieves a worker of carriage of sheets of paper and improves the bookbinding efficiency, and a prebinding apparatus which is installed in the bookbinding machine.

A bookbinding machine according to the present invention includes a prebinding apparatus which cuts edge portions of at least some of plural sheets of paper continuously supplied thereto, and a bookbinding apparatus which is continuously supplied with the plural sheets of paper from the prebinding apparatus, stacks the plural sheets of paper by a predetermined number, and binds and folds the plural sheets of paper. The prebinding apparatus includes a feeding section which feeds the supplied sheets of paper one by one, a cutting section which cuts edge portions of those sheets of paper which are on a feeding path for the sheets of paper formed by the feeding section, and a control section which sorts the supplied sheets of paper into cutting-needed sheets of paper whose edge portions should be cut and non-cutting-needed sheets of paper whose edge portions need not be cut, and controls the feeding section and the cutting section based on a result of that sorting in such a way as to cut the edge portions of the cutting-needed sheets of paper and not to cut the edge portions of the non-cutting-needed sheets of paper.

According to the present invention, the prebinding apparatus and the bookbinding apparatus are connected together on line and sheets of paper pass the prebinding apparatus and the bookbinding apparatus in the named order. This makes it unnecessary for a worker to carry sheets of paper, thus increasing the processing speed and improving the bookbinding efficiency. The bookbinding efficiency is further improved by the control section which sorts sheets of paper into cutting-needed sheets of paper and non-cutting-needed sheets of paper, and controls the feeding section and the cutting section and performs a margin-cutting process only on the cutting-needed sheets of paper based on the sorting result. In addition, the prebinding apparatus and the bookbinding apparatus can be operated systematically, thus resulting in a lower operational burden and an improved bookbinding efficiency.

It is preferable that the cutting section should have a feeding-directional cutting section which cuts the cutting-needed sheets of paper in a direction parallel to a feeding direction to cut edge portions of the cutting-needed sheets of paper which extend in the feeding direction. This makes it possible to efficiently remove those edge portions of cutting-needed sheets which extend in the feeding direction.

It is also preferable that the cutting section should have an orthogonal-to-feeding-direction cutting section which cuts the cutting-needed sheets of paper in a direction orthogonal to a feeding direction to cut edge portions of the cutting-needed sheets of paper which extend in the direction orthogonal to the feeding direction. This makes it possible to efficiently remove those edge portions of cutting-needed sheets which extend in a direction orthogonal to the feeding direction.

It is preferable that the prebinding apparatus should further include a bypass section which causes the non-cutting-needed sheets of paper to bypass the cutting section and feeds the non-cutting-needed sheets of paper toward the bookbinding apparatus, and a feeding-path changing section which feeds the cutting-needed sheets of paper to the cutting section and feeds the non-cutting-needed sheets of paper to the bypass section based on the result of sorting done by the control section. While the bypass section is feeding the non-cutting-needed sheets of paper, bypassing the cutting section, the cutting section can cut edge portions of cutting-needed sheets of paper. The ability to process non-cutting-needed sheets of paper and cutting-needed sheets of paper in parallel can further improve the processing efficiency.

The prebinding apparatus should preferably further include a creasing section which forms creases at those portions of the cutting-needed sheets of paper which are to be folded by the bookbinding apparatus. This structure can prevent occurrence of cracking at a folded portion when thick sheets of paper are used.

The control section should preferably perform the sorting based on information input beforehand. This can ensure automatic operation of the bookbinding machine.

The bookbinding machine may further include a sheet feeder which continuously feeds the sheets of paper to the prebinding apparatus. Further, the sheet feeder may include a first sheet feeding shelf where the cutting-needed sheets of paper are to be supplied, and a second sheet feeding shelf where the non-cutting-needed sheets of paper are to be supplied, and the sheet feeder may continuously feed the cutting-needed sheets of paper and the non-cutting-needed sheets of paper to the prebinding apparatus in a predetermined order. Even when images are formed on cutting-needed sheets of paper and non-cutting-needed sheets of paper by separate image forming apparatuses, therefore, it becomes easier to supply image-formed sheets of paper to the prebinding apparatus.

Or, the bookbinding machine may include an image forming apparatus which forms images on the sheets of paper and continuously feeds those image-formed sheets of paper to the prebinding apparatus. This allows the image forming apparatus, the prebinding apparatus and the bookbinding apparatus to be connected together on line, resulting in a further improvement on the bookbinding efficiency.

It is preferable that the image forming apparatus should include a first sheet feeding shelf where the cutting-needed sheets of paper on which images have not been formed yet are to be supplied, and a second sheet feeding shelf where the non-cutting-needed sheets of paper on which images have not been formed yet are to be supplied, and the image forming apparatus should form images on the cutting-needed sheets of paper and the non-cutting-needed sheets of paper and continuously feed the cutting-needed sheets of paper and the non-cutting-needed sheets of paper to the prebinding apparatus, in a predetermined order. This permits cutting-needed sheets of paper and non-cutting-needed sheets of paper to be separately supplied to the image forming apparatus, thus making sheet supplying easier.

A prebinding apparatus according to the present invention is connected to an input side of a bookbinding apparatus which is continuously supplied with plural sheets of paper, stacks the plural sheets of paper by a predetermined number, and binds and folds the plural sheets of paper, continuously supplies the plural sheets of paper to the bookbinding apparatus. The prebinding apparatus includes a feeding section which feeds supplied sheets of paper to the bookbinding apparatus one by one, a cutting section which cuts edge portions of those sheets of paper which are on a feeding path for the sheets of paper formed by the feeding section, and a control section which sorts the supplied sheets of paper into cutting-needed sheets of paper whose edge portions should be cut and non-cutting-needed sheets of paper whose edge portions need not be cut, and controls the feeding section and the cutting section based on a result of that sorting in such a way as to cut the edge portions of the cutting-needed sheets of paper and not to cut the edge portions of the non-cutting-needed sheets of paper.

According to the present invention, as the prebinding apparatus and the bookbinding apparatus are connected together on line, it is possible to continuously process and bind sheets of paper. This relieves a worker of carrying sheets of paper, thus improving the bookbinding efficiency. As the control section sorts image-formed sheets of paper into cutting-needed sheets of paper and non-cutting-needed sheets of paper, and the cutting section performs a cutting process only on the cutting-needed sheets of paper, the processing time needed for bookbinding can be made shorter.

BRIEF DESCRIPTION OF THE DRAWINGS

FIGS. 7A to 7F are diagrams which illustrate sheets of paper to be bound by the bookbinding machine according to the embodiment, and in which FIG. 7A is a plan view showing a sheet of paper for color printing, FIG. 7B is a perspective view showing a booklet after bookbinding, and FIGS. 7C to 7F are plan views showing a sheet of paper for monochromatic printing;

DETAILED DESCRIPTION OF THE PREFERRED EMBODIMENTS

Figure 1:
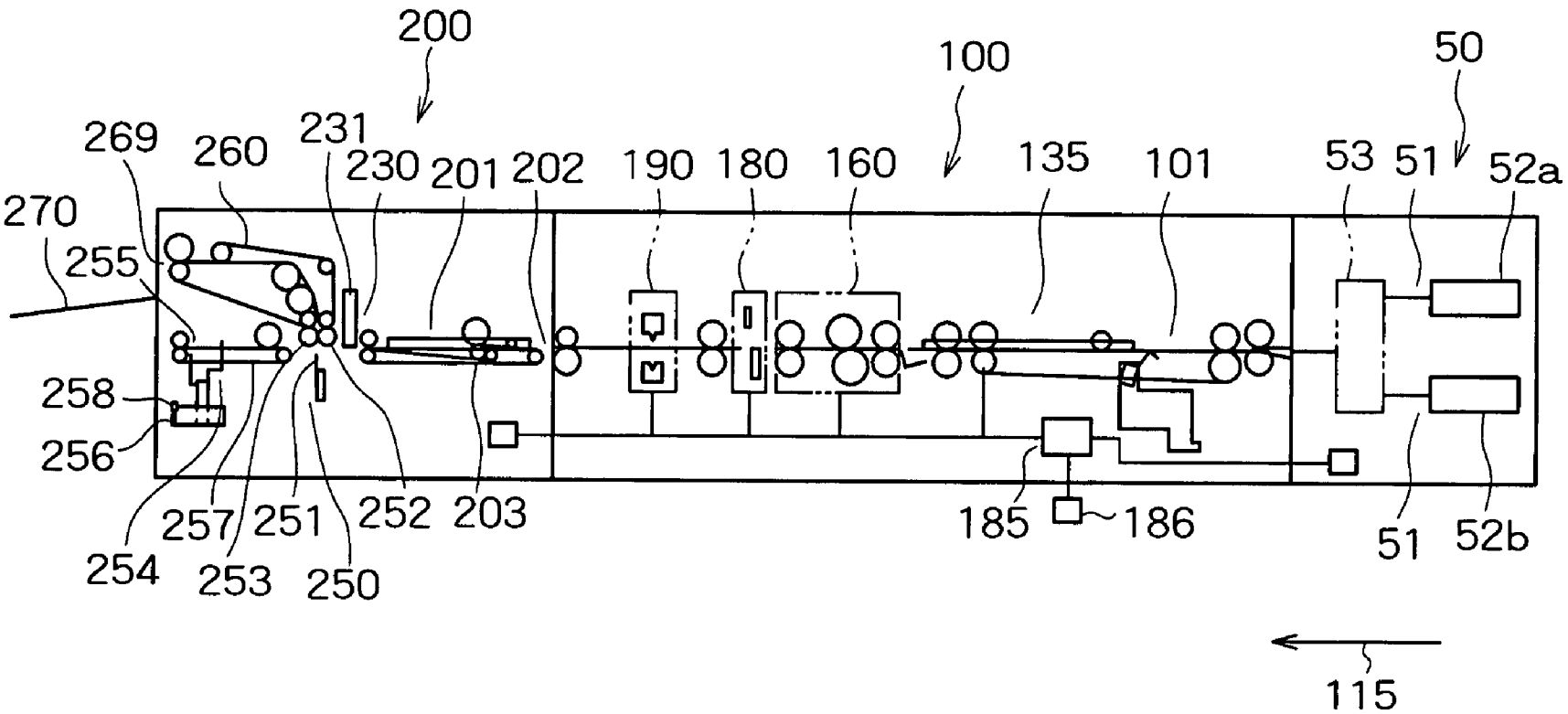
FIG. 1 is a side view illustrating a bookbinding machine according to a first embodiment of the invention.
Figure 2:
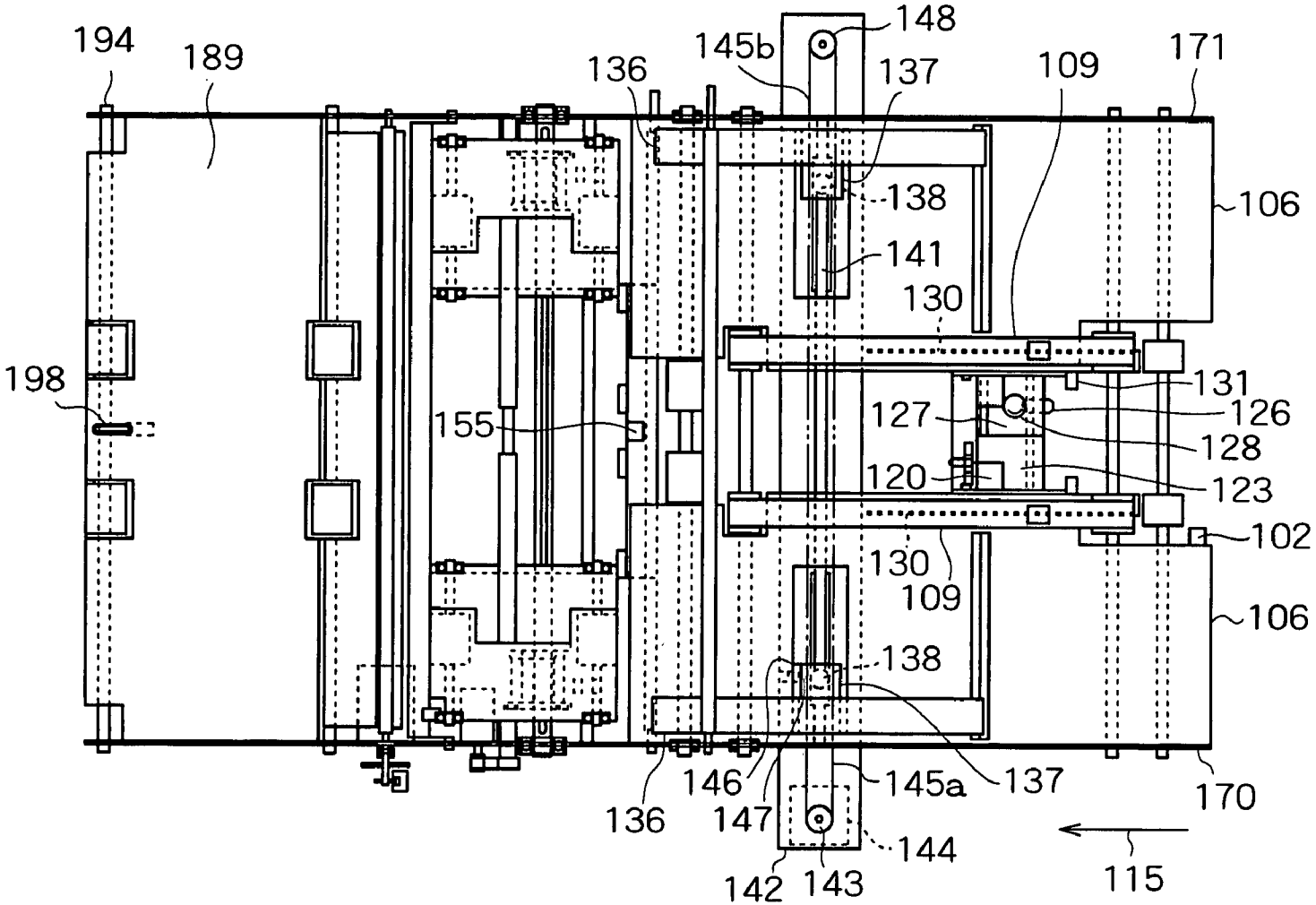
FIG. 2 is a plan view illustrating a prebinding apparatus in the bookbinding machine shown in FIG. 1.
Figure 3:
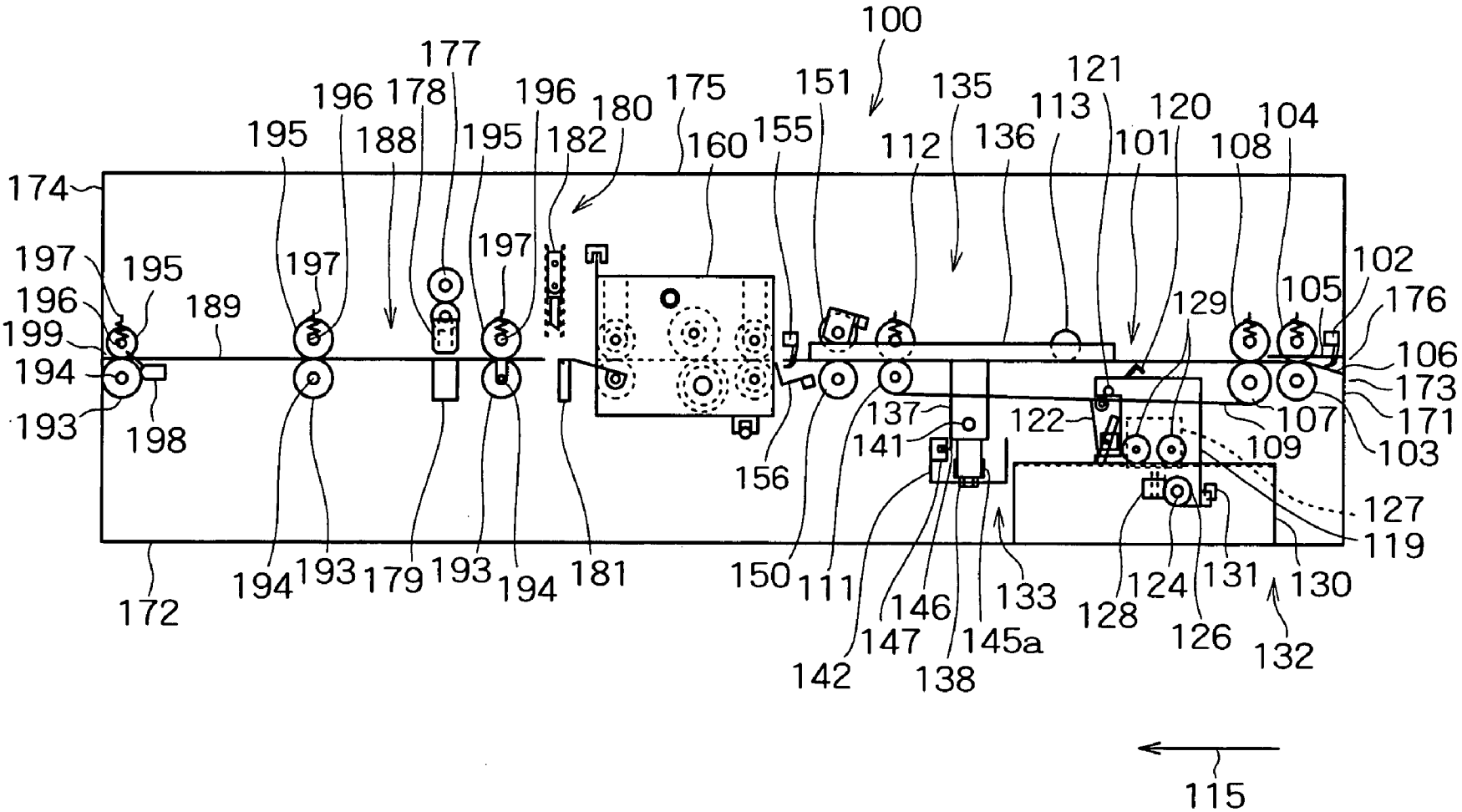
FIG. 3 is a side view showing the neighborhood around the prebinding apparatus.
Figure 4:
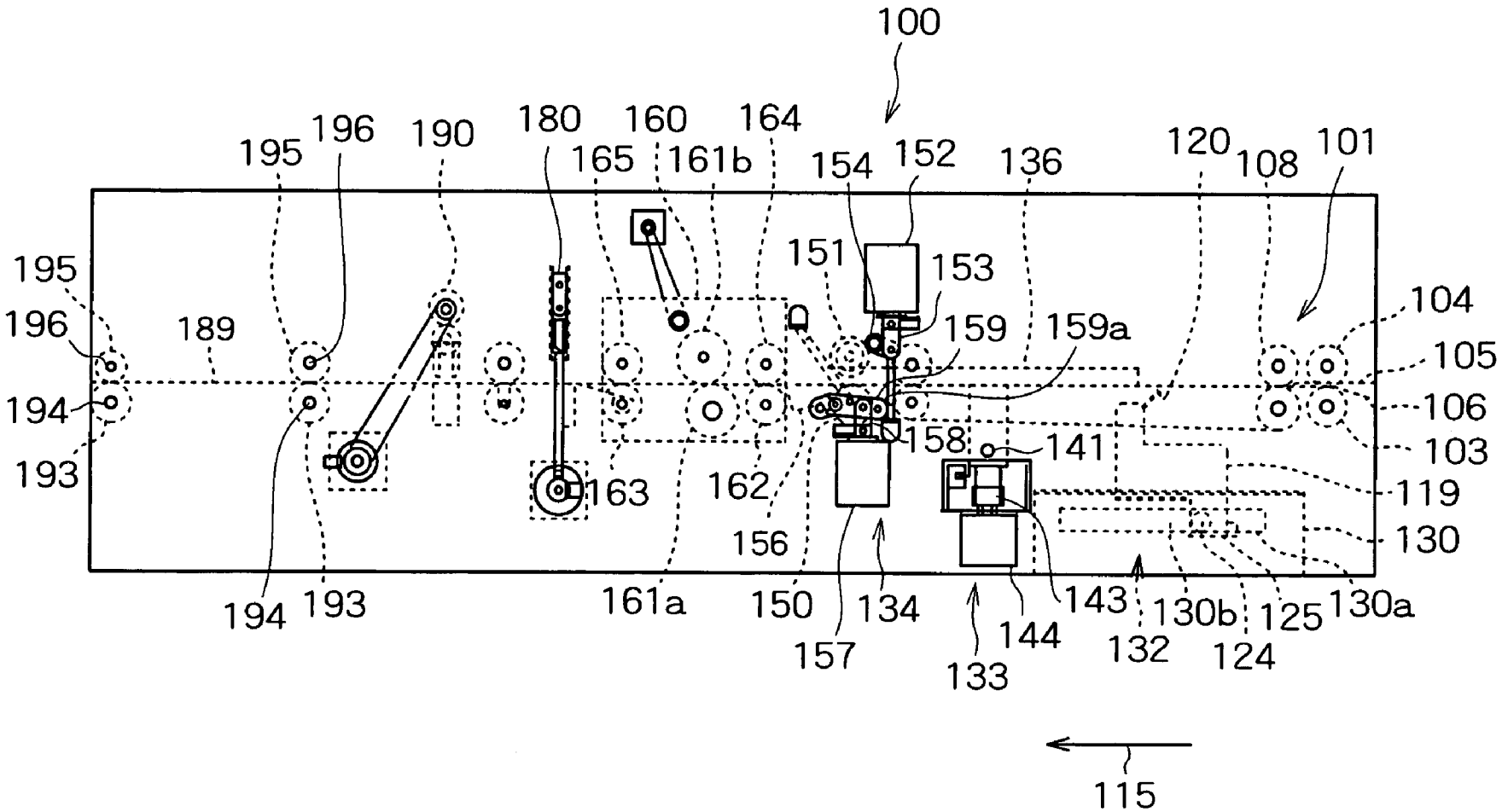
FIG. 4 is a side view showing the neighborhood around the side portion of the prebinding apparatus.
Figure 5:
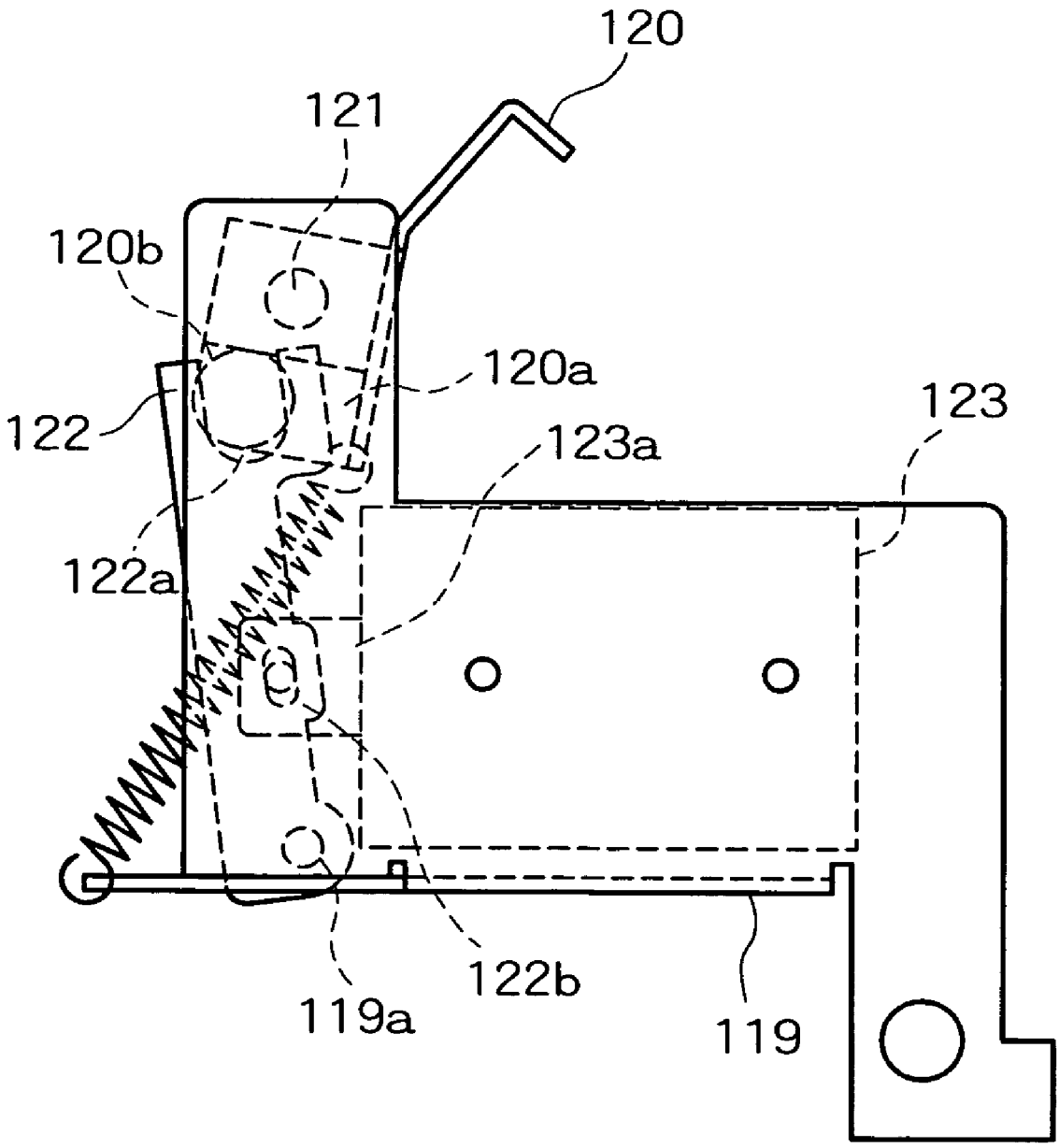
FIG. 5 is a side view showing a sheet-rear-end aligning device of the prebinding apparatus.
Figure 6:
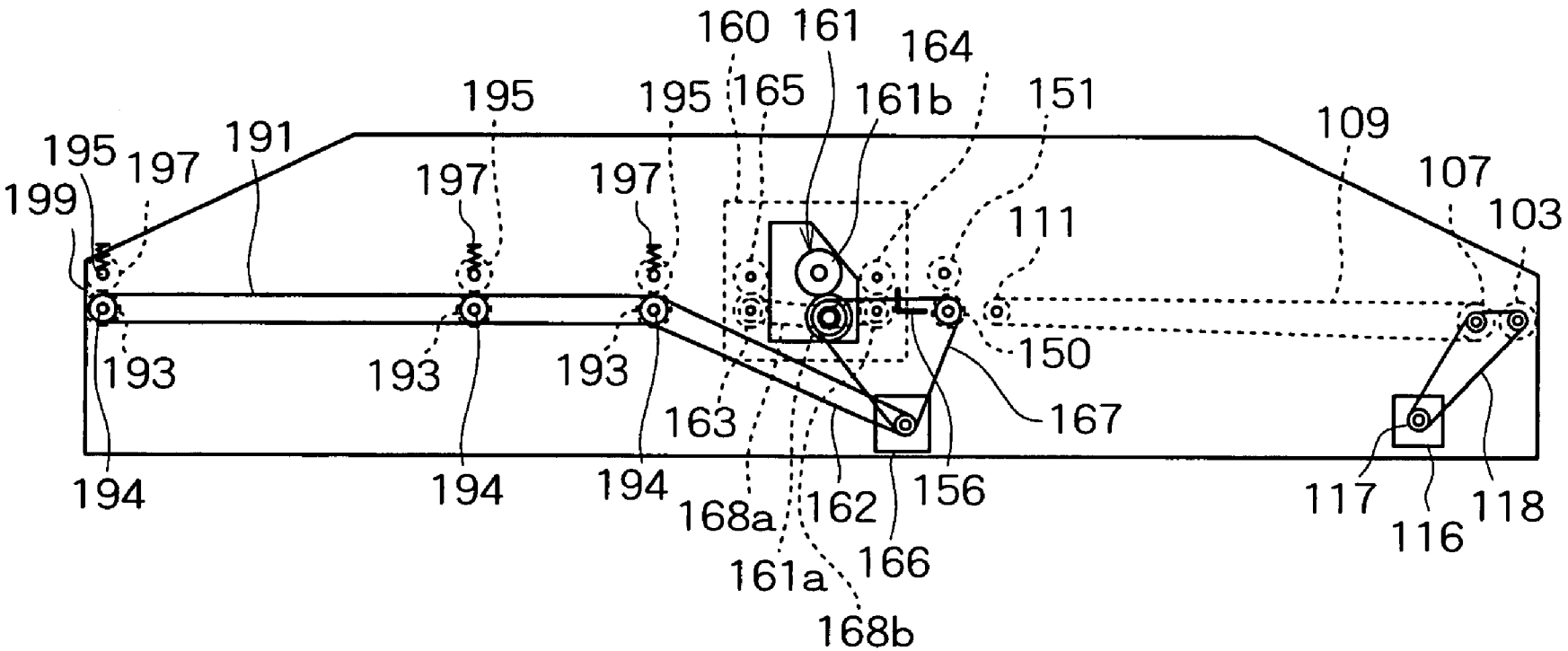
FIG. 6 is a side view showing a conveyance drive mechanism section of the prebinding apparatus.

Preferred embodiments of the invention will be described below with reference to the accompanying drawings. To begin with, the first embodiment of the present invention will be described. FIG. 1 is a side view illustrating a bookbinding machine according to the embodiment, FIG. 2 is a plan view illustrating a prebinding apparatus in the bookbinding machine shown in FIG. 1, FIG. 3 is a side view showing the neighborhood around the prebinding apparatus, FIG. 4 is a side view showing the neighborhood around the side portion of the prebinding apparatus, FIG. 5 is a side view showing a sheet-rear-end aligning device of the prebinding apparatus, and FIG. 6 is a side view showing a conveyance drive mechanism section of the prebinding apparatus. The bookbinding machine according to the embodiment binds a booklet formed of monochromatically printed pages and colored pages printed in color. The monochromatically printed pages are formed thin sheets of paper and each has margins at the peripheral portion, and the colored pages are formed thin sheets of paper and printed in full size without having any margin.

In the bookbinding machine according to the embodiment, as shown in FIG. 1, an image forming apparatus 50, a prebinding apparatus 100 and a bookbinding apparatus 200 are coupled on line in this order. An arrow 115 in FIG. 1 shows the feeding direction of sheets of paper in the bookbinding machine. A horizontal direction orthogonal to the arrow 115, i.e., a direction perpendicular to the sheet of FIG. 1 is the widthwise direction of the bookbinding machine. The image forming apparatus 50, the prebinding apparatus 100 and the bookbinding apparatus 200 can be controlled systematically using a same operation panel 186.

The image forming apparatus 50 is, for example, a PCC (copy machine) or a laser printer. In the image forming apparatus 50, a sheet feeding section 51 is provided with two sheet feeding shelves 52*a* and 52*b*. The sheet feeding shelf 52*a* is arranged at an upper stage, and the sheet feeding shelf 52*b* is arranged at a lower stage. Blank sheets of paper (not shown) are supplied to the sheet feeding shelves 52*a* and 52*b*. An image forming section 53 is provided at the subsequent stage of the sheet feeding section 51. The image forming section 53 forms images on the top surfaces of sheets of paper, continuously supplied thereto one at a time from the sheet feeding section 51, and discharges the sheets of paper one after another.

Sheets of paper on which images are formed by the image forming section 53 (image-formed sheets of paper) are sequentially supplied to the prebinding apparatus 100. The prebinding apparatus 100 is provided with a conveying section 101. The conveying section 101 feeds image-formed sheets of paper from the image forming apparatus 50 to the bookbinding apparatus 200 one by one along the downstream side of the feeding direction 115 (hereinafter simply called "downstream side"). The prebinding apparatus 100 is provided with a sheet aligning section 135 which aligns the positions of the image-formed sheets of paper fed by the conveying section 101. The sheet aligning section 135 determines the start position (reference position) of sheet feeding. A slitting section 160 is provided on the downstream side of the sheet aligning section 135. The slitting section 160 slits image-formed sheets of paper in the feeding direction, and cuts off edge portions extending in the feeding direction or margins at both side portions. A cutting section 180 is provided on the downstream side of the slitting section 160. The cutting section 180 cuts image-formed sheets of paper in a direction orthogonal to the feeding direction, and cuts off edge portions extending in the direction orthogonal to the feeding direction or top and bottom margins. Provided on the downstream side of the cutting section 180 is a creasing section 190 which forms creases at those portions of image-formed sheets of paper which are to be folded by the bookbinding apparatus 200.

The prebinding apparatus 100 is provided with a control section 185. The control section 185 is comprised of a microprocessor or the like and is connected with the operation panel 186. The control section 185 sorts image-formed sheets of paper into cutting-needed sheets which need cutting of margins and/or creasing and non-cutting-needed sheets which do not need cutting of margins and creasing based on information input through the operation panel 186, and controls the operations of the conveying section 101, the slitting section 160, the cutting section 180 and the creasing section 190 based on the sorting result. Accordingly, the slitting section 160, the cutting section 180 and the creasing section 190 perform an SCC (Slit, Cut and Crease) process only on cutting-needed sheets and do not perform the SCC step on non-cutting-needed sheets. With the structure of the prebinding apparatus 100, image-formed sheets supplied to the prebinding apparatus 100 are fed to the conveying section 101, and supplied to a sheet inlet port 202 of the bookbinding apparatus 200 after passing the slitting section 160, the cutting section 180 and the creasing section 190. Information to be input to the control section 185 includes, for example, the number of sheets of paper contained in a booklet, the page numbers of sheets of paper to undergo the SCC step, the full width and the full length of sheets of paper, and the size of margins. As those pieces of information are input, sheets of paper can be cut to the desired size according to the size of the sheets of paper. It is also possible to correct the cutting conditions as needed, while checking the cut state.

The bookbinding apparatus 200 is provided with a sheet stacking/aligning section 201 which stacks image-formed sheets of paper, sequentially supplied from the prebinding apparatus 100, for a booklet and aligns the edges of the sheets of paper. The sheet stacking/aligning section 201 is provided with a belt 203 and a belt 257 which support and convey sheets of paper. A stopper base 256 is movably provided at the downstream of the feeding path in the sheet stacking/aligning section 201. A saddle stitch stopper 254 and a crease stopper 255 are coupled to the stopper base 256 in such a way as to be movable up and down. At elevated positions, the saddle stitch stopper 254 and the crease stopper 255 have their upper edge portions intervening in the feeding path to stop the movement of fed sheets of paper and align the positions of the sheets of paper. That is, the saddle stitch stopper 254 and the crease stopper 255 align the feeding-directional positions of sheets of paper together with the belts 203 and 257 and a sheet-rear-end aligning device (not shown). The sheet stacking/aligning section 201 is provided with a sheet-side aligning device (not shown) which aligns the widthwise-directional positions of sheets of paper. Further, a sensor 258 which detects presence of sheets of paper is attached to the casing of the bookbinding apparatus 200, and the detecting member (not shown) of the sensor 258 is mounted to the stopper base 256. The sensor 258 detects the position of the stopper base 256, and serves as a home-position sensor which allows the position of the stopper base 256 to be controlled according to the size of sheets of paper to be processed, so that the saddle stitch stopper 254 and the crease stopper 255 move to the adequate positions.

A stitch section 230 is provided near the center of the sheet stacking/aligning section 201 and is provided with a stitcher 231. The stitcher 231 stitches sheets of paper for one booklet, stacked by the sheet stacking/aligning section 201, and connects the sheets of paper together.

A folding section 250 is provided on the downstream side of stitch section 230. At the folding section 250, a folding knife 251 is provided at the downstream of the sheet feeding direction in such a way as to be movable up and down, and a pair of folding rollers 252 and 253 are provided at the upstream side of the sheet feeding direction. As the folding knife 251 moves upward, the center portion of a sheet of paper is held by the folding rollers 252 and 253 so that the sheet is folded.

A conveying section 260 is provided above the folding rollers 252 and 253. The conveying section 260 has two annular belts each of which is stretched by a plurality of rollers and is driven as the rollers roll. As the two belts are driven, a booklet held and folded by the folding rollers 252 and 253 is conveyed to a discharge port 269 from the folding section 250. A tray 270 is provided outside the casing of the bookbinding apparatus 200 and directly below the discharge port 269, so that the booklet discharged through the discharge port 269 is placed on the tray 270.

The structure of the prebinding apparatus 100 will be discussed more specifically referring to FIGS. 2 to 6. As shown in FIGS. 2 and 3, the prebinding apparatus 100 is provided with a bottom plate 172 to which two plate-like frames 170 and 171 are fixed in such a way that their top surfaces are in parallel to the feeding direction 115 and the perpendicular direction. The frames 170 and 171 constitute both side portions of the prebinding apparatus 100. A front panel 173 is provided at the end of the upstream side of the feeding direction 115 (hereinafter simply called "upstream side") between the frame 170 and the frame 171 in such a way that its top surface is orthogonal to the feeding direction 115. A rear panel 174 is provided at the downstream end of the feeding direction 115 in such a way that its top surface is orthogonal to the feeding direction 115. Further, a top plate 175 is provided on the frames 170 and 171, the front panel 173 and the rear panel 174. The frames 170 and 171, the front panel 173, the rear panel 174 and the top plate 175 constitute the casing of the prebinding apparatus 100. The front panel 173 is provided with a sheet feed port 176 to which sheets of paper are supplied from the image forming apparatus 50. The rear panel 174 is provided with a sheet discharge port 199. The sheet feeding path is so set as to extend from the sheet feed port 176 to the sheet discharge port 199. A sheet sensor 102 is provided inside the sheet feed port 176.

In the conveying section 101, two guide plates 106 are provided on the same plane, nearly horizontal, along both side portions of the feeding path, and the upstream ends of the guide plates 106 are positioned directly under the sheet feed port 176 of the front panel 173. The two guide plates 106 are coupled, apart from each other, to the frames 170 and 171, respectively. Two guide plates 105 are provided above the respective guide plates 106 nearly in parallel to the guide plates 106, and the upstream ends of the guide plates 105 are positioned directly above the sheet feed port 176.

Accordingly, space between the guide plates 106 and the guide plates 105 serves as the sheet feeding path along which sheets of paper are supplied. A pair of feed-in rollers 103 are provided rotatable between the guide plates 106, and a pair of feed-in rollers 104 are provided rotatable between the guide plates 105. The feed-in rollers 104 are urged toward the feed-in rollers 103 by a spring, so that as a sheet of paper is supplied through the sheet feed port 176, the sheet is held by the feed-in rollers 103 and the feed-in rollers 104.

Two roller sets each comprised of a belt drive roller 107 and a belt-driven roller 111 are provided at the downstream side of the feed-in rollers 103 between the guide plates 106. Annular conveyance belts 109 are stretched over the respective roller sets to be a belt conveyor. The rollers in each roller set are rotatably supported on the frames 170 and 171. There is a motor 116 whose rotary shaft 117 is coupled to the belt drive roller 107 by a belt 118. As the motor 116 is driven, the rotary shaft 117 rotates and the rotation of the rotary shaft 117 is transmitted to the belt drive roller 107 via the belt 118, rotating the conveyance belt 109. A belt-driven roller 108 is rotatably provided above the belt drive roller 107, and is urged toward the conveyance belt 109 by a spring. A belt-driven roller 112 is rotatably provided above the belt-driven roller 111, and is urged toward the conveyance belt 109 by a spring. The top side of the conveyance belt 109 is set at a position slightly higher than the top side of the guide plate 106. Accordingly, a sheet of paper is held by the belt-driven rollers 108 and 112 and the conveyance belt 109, and is fed in the feeding direction 115 as the conveyance belt 109 rotates.

In the sheet aligning section 135, a sheet-rear-end aligning device 132, a sheet-side aligning device 133 and a sheet-front-end aligning device 134 are provided toward the downstream side from the upstream side. A feed roller 150 is provided under the feeding path, and a driven roller 151 is provided above the feeding path, so that a sheet of paper is held and fed by the feed roller 150 and the driven roller 151. A sheet sensor 155 is provided near a stopper 156.

As shown in FIG. 5, the sheet-rear-end aligning device 132 is provided with a pair of guide plates 130 fixed to the bottom plate 172 and perpendicularly standing upright. A jog base 119 is provided below the guide plates 106. A back jogger 120 is rotatably coupled to the jog base 119 via a support shaft 121. A solenoid 123 is attached to the jog base 119. A passive portion 120*a* is formed at the back jogger 120, with a post 120*b* attached to the passive portion 120*a*.

A support shaft 119*a* is mounted to the jog base 119, and one end of a lever 122 is rotatably coupled to the support shaft 119*a*. A U-shaped notch 122*a* is formed at the other end of the lever 122, and the post 120*b* of the back jogger 120 is loosely fitted in the notch 122*a*. An elongated hole 122*b* is formed in the center portion of the lever 122, and a plunger 123*a* of the solenoid 123 is mounted in the elongated hole 122*b*. A spring is tightly stretched between the jog base 119 and the back jogger 120, and urges the back jogger 120 in such a way that the back jogger 120 turns clockwise in FIG. 5 about the support shaft 121. The back jogger 120 turns to the stopper (not shown).

As the solenoid 123 is excited, the lever 122 turns clockwise in FIG. 5 about the support shaft 119*a*. Then, the back jogger 120 turns counterclockwise in the diagram about the support shaft 121. Accordingly, the back jogger 120, together with the sheet-front-end aligning device 134, aligns the feeding-directional position of sheets of paper.

As shown in FIG. 3, a pair of rollers 129 are rotatably attached to both sides of the jog base 119. The rollers 129 roll in contact with the top sides of the guide plates 130 and guide the jog base 119 along the upper edges of the guide plates 130. A large notch 130*b* (see FIG. 4) is formed in the guide plate 130, and a rack 130*a* is arranged in the vicinity of the large notch 130*b*. A drive shaft 124 is provided at the jog base 119. Pinion gears 125 are respectively attached to those portions of the drive shaft 124 which are located outside the jog base 119 and are engaged with the rack 130*a*. A worm wheel 126 is attached to that portion of the drive shaft 124 which is located inside the jog base 119, and is engaged with a worm gear 128 of a motor 127 mounted to the jog base 119. The motor 127 is, for example, a stepping motor.

As the motor 127 is driven, the drive shaft 124 rotates, and the pinion gears 125 rotate too. As the pinion gears 125 engaged with the rack 130*a* rotate, the jog base 119 moves with the rollers 129 being guided to the guide plates 130, and the back jogger 120 moves together. The formation of the notches 130*b* in the guide plates 130 allows the pinion gears 125 to move without interfering the guide plates 130. The initial position (home position) of the jog base 119 is detected as the detection portion (not shown) of the jog base 119 blocks a sensor 131. As the jog base 119 moves toward the downstream side of the feeding direction from the initial position, the back jogger 120 is placed at a position according to the size of sheets of paper. As a result, the back jogger 120 presses the rear end portion of a sheet of paper toward the downstream side of and the leading edge of the sheet of paper is pressed against the stopper 156, thereby adjusting the position of the sheet of paper in the feeding direction 115.

In the sheet-side aligning device 133, a chassis 142 is provided in such a way that it extends in the widthwise direction of the bookbinding machine to be stretched between the frame 170 and the frame 171, and its both end portions protrude outward from between the frames 170 and 171. The cross section of the chassis 142 parallel to the feeding direction 115 has a square-bracket shape open upward. A motor 144 is provided in the chassis 142 at that portion which corresponds to outside the frame 170. A pulley 148 is provided above the chassis 142 at that portion which corresponds to outside the frame 171. A guide shaft 141 stretches in the chassis 142 between the frames in such a way as to the axial direction becomes the widthwise direction. A pair of guide blocks 137 are provided in the chassis 142 between the frames, and the guide shaft 141 is inserted in the guide blocks 137. A notch (not shown) is formed in the bottom of the chassis 142 in such a way that the left direction becomes the widthwise direction of the bookbinding machine. A roller 138 is attached to the bottom side of each guide block 137 in such a way as to be fitted in the notch. A side guide 136 is fixed to the top side of each guide block 137. The side guides 136 abut on the side edges of a sheet of paper and adjust the position of a sheet of paper in the widthwise direction.

The pair of guide blocks 137 are fixed to a belt 145 stretched between a pulley 143 and the pulley 148, provided on both outer sides of the frames via mount members (not shown). One of the guide blocks 137 is fixed to one running portion 145*a* of the belt 145, and the other guide block 137 is fixed to the other running portion, 145*bÿ* of the belt 145. As the signal processing/control section 143 is rotated by the motor 144 to rotate the belt 145 around, the pair of side guides 136 can be moved symmetrically in the widthwise direction. The initial position of the side guides 136 is detected as a fixed to one of the guide blocks 137 blocks a side-guide initial position sensor 147. As the side guides 136 move from the initial position and stop at a predetermined position, the side guides 136 are placed at a position corresponding to the size of the sheet of paper. This ensures alignment of the position of the sheet of paper in the widthwise direction.

The sheet-front-end aligning device 134 is provided with the stopper 156 which becomes the reference for the leading edge of a sheet of paper at the time of performing the slitting and cutting processes. The stopper 156 is attached to a mount shaft (not shown) rotatably provided at the pair of frames 170 and 171. One end of a passive lever (not shown) is attached to the mount shaft, with a post (not shown) attached to the other end of the passive lever. Attached to the frame 170 is a support shaft 159*a* to which one end of a lever 159 is rotatably attached. A U-shaped notch (not shown) is formed in the other end of the lever 159. The notch is loosely attached to the support of the passive lever. One en of a link 158 is attached to near the center portion of the lever 159, with the plunger of a solenoid 157 attached to the other end of the link 158. A spring (not shown) is tightly stretched between the frame 170 and the lever 159, and urges the stopper 156 in such a way as to turn the stopper 156 in the illustrated counterclockwise direction about the mount shaft. The stopper 156 turns until it abuts on a stopper member (not shown) and is placed at the standby position.

As the solenoid 157 is excited, the lever 159 turns in the illustrated counterclockwise direction about the support shaft 159*a*. This causes the stopper 156 to turn in the illustrated counterclockwise direction about the mount shaft. As a result, the stopper 156, together with the sheet-rear-end aligning device 132, is aligned at the position in the feeding direction of sheets of paper. This position becomes the reference feeding position when the slitting and cutting processes are carried out. In other words, to perform the slitting and cutting processes, the stopper 156 turns to come into the feeding path to stop sheets of paper. When the slitting and cutting processes are not performed, the stopper 156 is kept at a position away from the feeding path, allowing sheets of paper to pass.

The feed roller 150 is provided in the sheet feeding path, and the driven roller 151 is provided above the feeding path in such a way as to be movable close to and away from the feed roller 150. The driven roller 151 is rotatably supported on a roller bracket (not shown) attached to the mount shaft rotatably supported at the pair of frames 170 and 171. The rolling mechanism of the driven roller 151 is similar to the rolling mechanism of the stopper 156 of the sheet-front-end aligning device 134; a passive lever is attached to the mount shaft and the operation of a solenoid 152 allows the driven roller 151 to be rotatable via a link 153 and the lever 159. In executing the slitting and cutting processes, the roller bracket rotates counterclockwise in the illustrated counterclockwise direction so that the driven roller 151 rolls contact with the feed roller 150. When the slitting and cutting processes are not performed, the driven roller 151 is kept apart from the feed roller 150. The conveying section 101 and the sheet aligning section 135 constitute the feeding section.

A pair of slitters 161 are provided in the slitting section 160 at both sides of the feeding path. Each of the slitters 161 is comprised of two disk-shaped cutters 161*a* and 161*b*. The cutter 161*a* is located below the feeding path, and the cutter 161*b* is located above the feeding path. A roller 162 is provided at the upstream of the cutter 161*a*, and a roller 163 is provided at the downstream of the slitter 161. Further, rollers 164 and 165 are provided above the rollers 162 and 163, respectively, and, together with the rollers 162 and 163, hold a sheet of paper. A motor 166 is provided below the feeding path and the rotary shaft of the motor 166 is coupled via a belt 167 to the rotary shafts of the feed roller 150 and the cutter 161*a* whose rotary shaft is coupled to the rollers 162 and 163 via belts 168*a* and 168*b*. According to the embodiment, the motor 166 is, for example, a servo motor. As the motor 166 is driven, therefore, the cutter 161*a* rotates via the belt 167, and the belts 168*a* and 168*b* rotate accordingly. The rotation of the belts 168*a* and 168*b* causes the rollers 162, 163, 164 and 165 to rotate. This makes it possible to cut a sheet of paper in the feeding direction 115 and cut both side portions of the sheet or the edge portions extending in the feeding direction 115, while feeding the sheet in the feeding direction 115.

The slitters 161, the rollers 162 to 165, and the belts 168*a* and 168*b* are disposed at the slitter bracket, constituting a slitter unit. The slitter unit is fitted over a guide shaft fixed to the frames 170 and 171, and is screwed on a screw shaft which is rotatable with respect to the frames 170 and 171. One cutting portion is screwed onto one screw portion of the screw shaft, while the other cutting portion is screwed onto the other screw portion. The threads of those screw portions are formed in the opposite directions. As the motor rotates, the screw shaft rotates, continuously narrowing the interval between one cutting portion and the other cutting portion from the initial position shown in FIG. 2. As both cutting portions are stopped at a predetermined position, they are set at the position matching the sheet size.

The cutting section 180 is provided with a lower blade 181 and an upper blade 182. As the upper blade 182 moves up and down, it is possible to cut a sheet of paper in the widthwise direction to cut the edge portions of the sheet of paper which extend in the widthwise direction.

The creasing section 190 is provided with an eccentric roller 177 above the sheet feeding path. A projection member 178 is provided below the eccentric roller 177 in such a way as to be in contact with the in such a way as to. The projection member 178 has a protruding portion at the bottom, extending in the widthwise direction. A recess member 179 is fixed below the feeding path. The recess member 179 has a recess portion formed at the top side. The recess portion is fitted over the protruding portion of the projection member 178 when the projection member 178 is at the lift-down position. Accordingly, as a sheet of paper is supplied between the projection member 178 and the recess member 179 and the eccentric roller 177 rotates, the projection member 178 is pressed by the eccentric roller 177 to move down to the lift-down position. As a result, the protruding portion of the projection member 178 is fitted in the recess portion of the recess member 179 via the sheet of paper, creasing the sheet of paper.

Feed rollers 193 are provided between the cutting section 180 and the creasing section 190, between the creasing section 190 and the sheet discharge port 199, and around the sheet discharge port 199 under the sheet feeding path. With feed shafts 194 being axes, the feed rollers 193 are rotatably supported at the frames 170 and 171. Driven rollers 195 are disposed above the respective feed rollers 193. With driven shafts 196 being rotary shafts, the driven rollers 195 are supported rotatably. The driven rollers 195 are urged toward the feed rollers 193 by springs 197. A belt 191 is tightly stretched over the rotary shaft of the motor 166 and the feed rollers 193. A guide plate 189 is provided below the feeding path between the creasing section 190 and the sheet discharge port 199 and supports a sheet of paper. Accordingly, a sheet of paper is held between the feed rollers 193 and the driven rollers 195, and the belt 191 rotates as the motor 166 is driven, thereby feeding the sheet of paper toward the sheet discharge port 199. A sheet sensor 198 is provided at the upstream of the downmost feed roller 193.

Figure 7A:
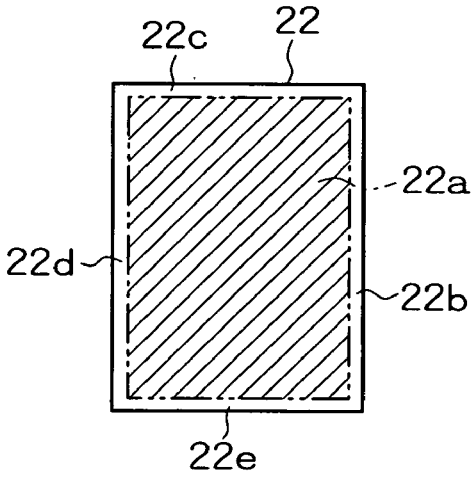
Figure 7B:
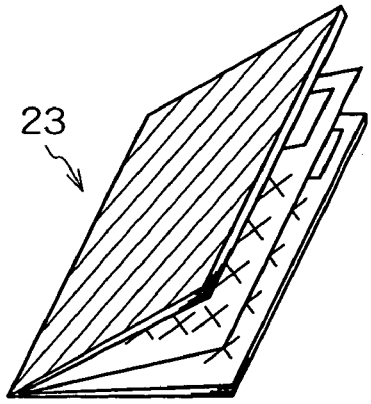

The operation of the first embodiment with the above-described structure will be discussed. FIGS. 7A to 7F illustrate sheets of paper to be bound by the bookbinding machine according to the embodiment. FIG. 7A is a plan view showing a color print sheet, FIG. 7B is a perspective view showing a booklet after bookbinding, and FIGS. 7C to 7F are plan views showing a monochromatic print sheet. A color print sheet 22 shown in FIG. 7A is the topmost one of sheet of paper stacked in the bookbinding apparatus 200, and constitutes outermost pages of a booklet 23 after bookbinding or the top and back covers. The color print sheet 22 has a print area 22*a* at the center portion, and margins 22*b*, 22*c*, 22*d* and 22*e* at the peripheral portion. The size of the color print sheet 22 is larger than the bookbinding size, which matches with the size of the print area 22*a*.

Figure 7C:
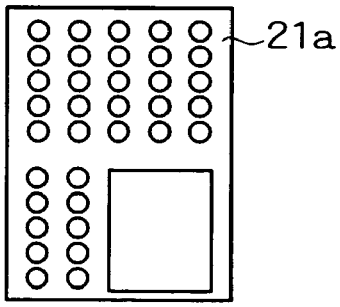
Figure 7D:
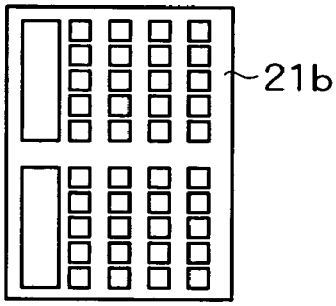
Figure 7E:
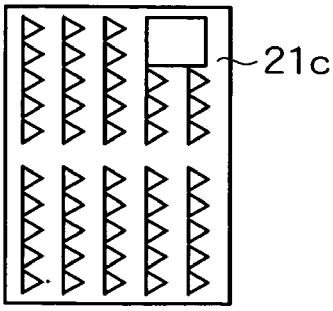
Figure 7F:
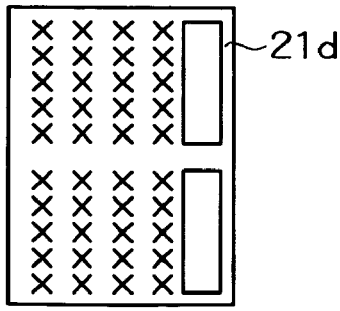

In the bookbinding apparatus 200, a monochromatic print sheet 21*a* shown in FIG. 7C is the second sheet from the top, a monochromatic print sheet 21*b* shown in FIG. 7D is the third sheet from the top, a monochromatic print sheet 21*c* shown in FIG. 7E is the fourth sheet from the top, and a monochromatic print sheet 21*d* shown in FIG. 7F is the fifth sheet from the top. The monochromatic print sheets 21*a* to 21*d* are also generically called "monochromatic print sheet 21". The size of the monochromatic print sheet 21 is the same as the bookbinding size or the size of the print area 22*a* of the color print sheet 22.

Figure 8A:
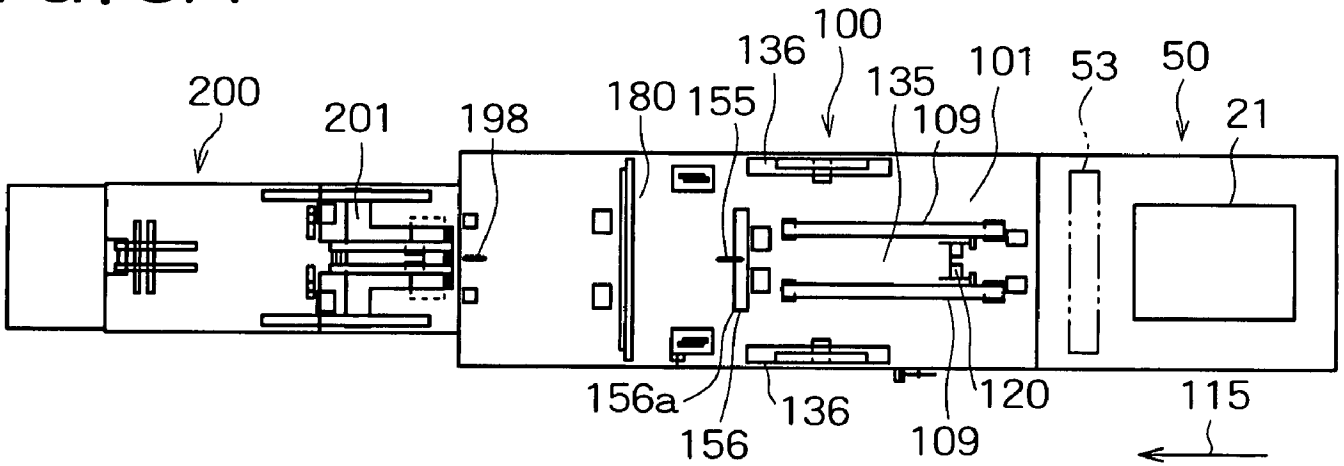
FIGS. 8A and 8B are a plan view and a side view of the bookbinding machine according to the embodiment showing one step in the operation of the bookbinding machine.
Figure 8B:
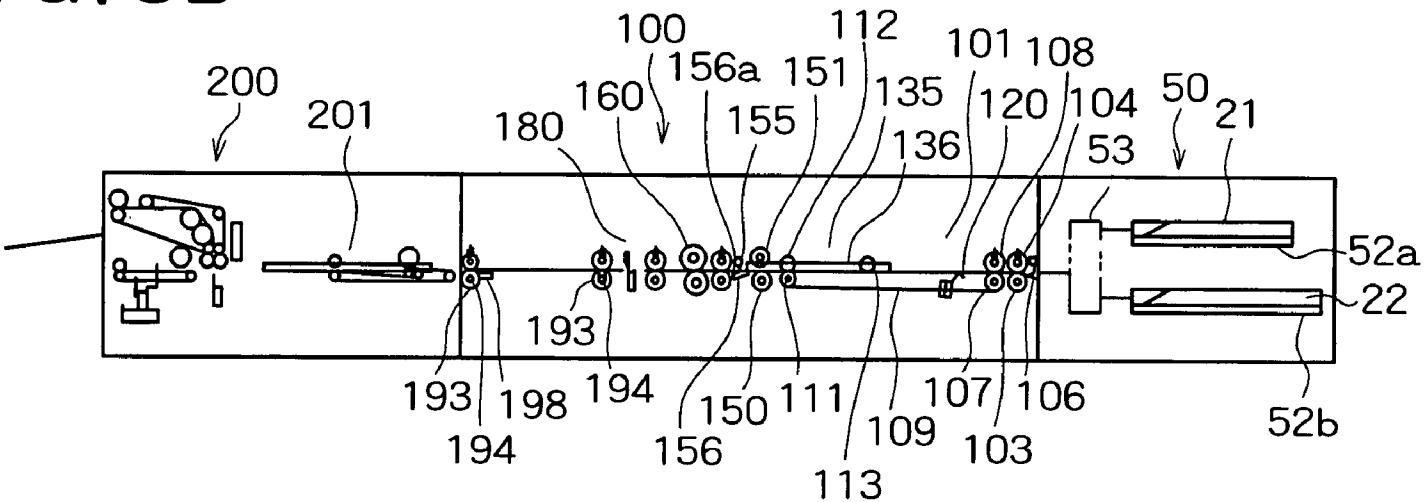

FIGS. 8A and 8B to FIGS. 16A and 16B are diagrams showing the operation of the bookbinding machine according to the embodiment step by step. Each diagram with the suffix "A" is a plan view, and each diagram with the suffix "B" is a side view. In the bookbinding machine according to the embodiment, the image forming apparatus 50, the prebinding apparatus 100 and the bookbinding apparatus 200 are operated systematically. With the bookbinding machine in a state before operation, as shown in FIGS. 8A and 8B, the monochromatic print sheets 21 before image formation are stacked on the sheet feeding shelf 52*a* of the image forming apparatus 50, and the color print sheet 22 before image formation is stacked on the sheet feeding shelf 52*b*. The driven roller 151 in the conveying section 101 of the prebinding apparatus 100 are positioned apart from one another, the jog base 119 of the sheet aligning section 135 is at the initial position, the back jogger 120 and the stopper 156 are the lift-down position, the slitter unit of the slitting section 160 is at the initial position, the upper blade 182 the cutting section 180 is positioned apart from the lower blade 181, and the projection member 178 of the creasing section 190 is positioned apart from the recess member 179. Information, such as the number of pages of a booklet, page numbers of sheets of paper to be subjected to the SCC step, the size of the sheets of paper to be subjected to the SCC step or the full width and full length of those sheets of paper, the final size of sheets of paper or the size of the margins or the full width and full length of the sheets of paper, and whether creases should be formed or not, is input through the operation panel 186 of the control section 185. The saddle stitch stopper 254 of the stopper base 256 of the bookbinding apparatus 200 is moved from the initial position to the proper position to perform the stitching process.

Figure 9A:
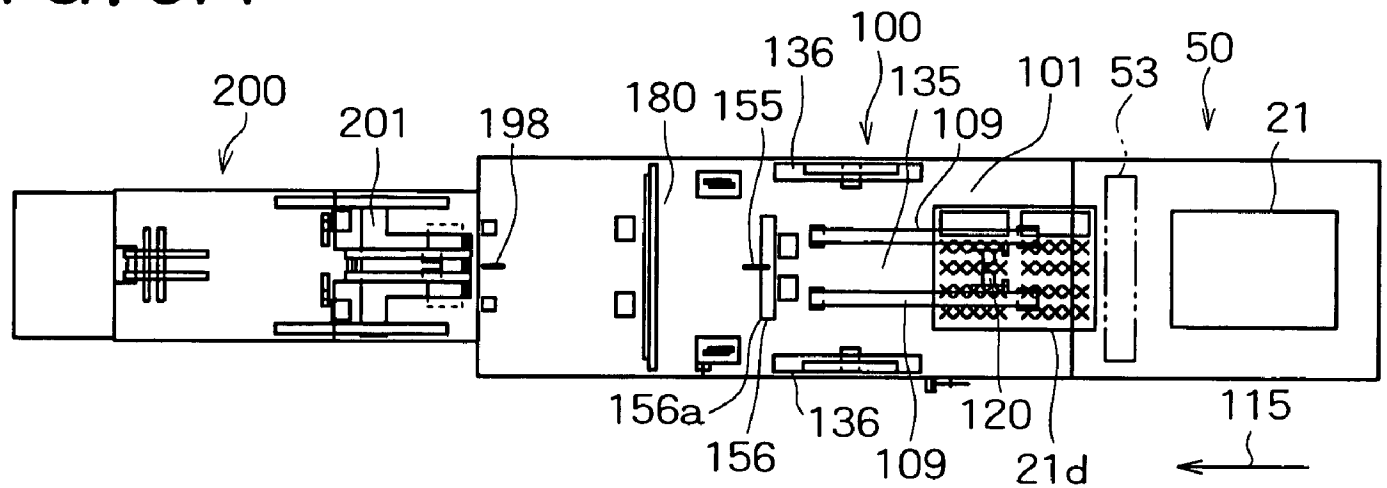
FIGS. 9A and 9B are a plan view and a side view of the bookbinding machine showing a next step in the operation of the bookbinding machine to the step shown in FIGS. 8A and 8B.
Figure 9B:
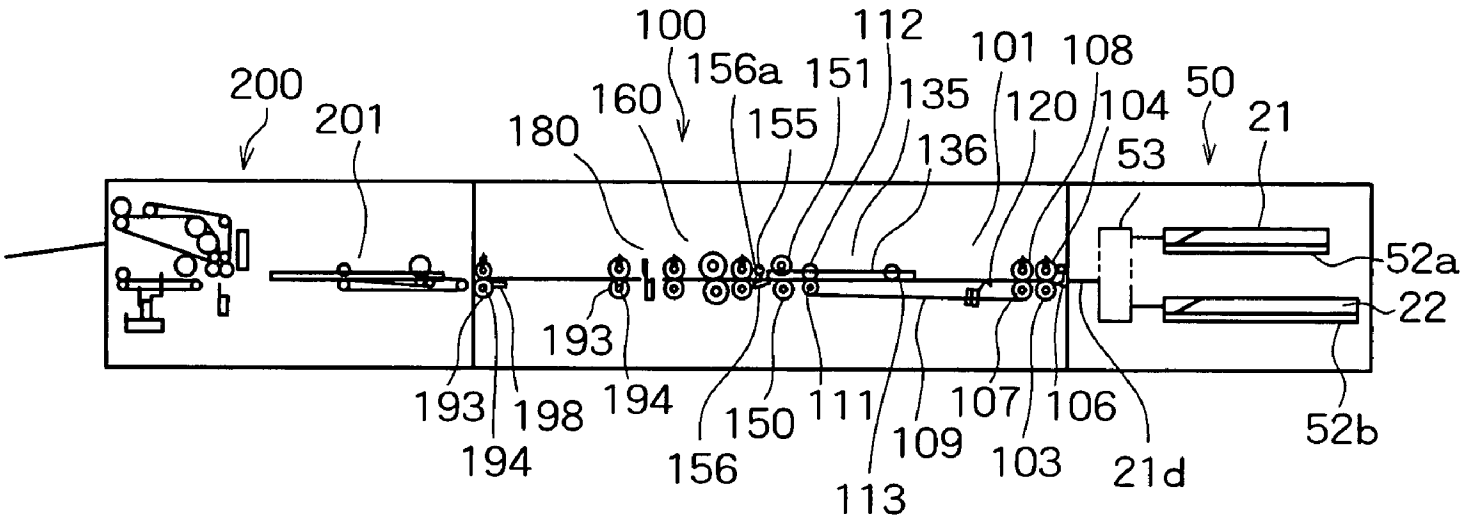

As shown in FIGS. 9A and 9B, a single monochromatic print sheet 21 is supplied to the image forming section 53 from the sheet feeding shelf 52*a*, and a monochromatic image is formed on the top surface of the monochromatic print sheet 21. As a result, the monochromatic print sheet 21 becomes the fifth monochromatic print sheet 21*d*. This monochromatic print sheet 21*d* is supplied into the prebinding apparatus 100 through the sheet feed port 176, and fed in the feeding direction 115 by the conveying section 101. Specifically, the motor 116 is driven, and the rotation of the rotary shaft 117 is transmitted to the feed-in rollers 103 and the belt drive roller 107 via the belt 118, thus rotating the conveyance belt 109 to feed the sheet 21*d*.

Figure 10A:
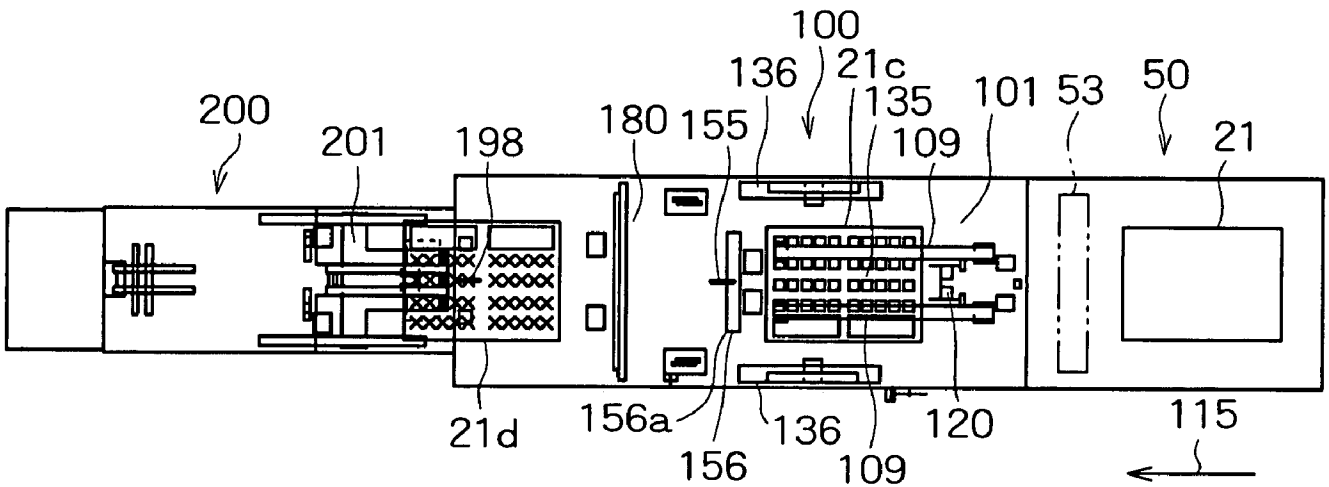
FIGS. 10A and 10B are a plan view and a side view of the bookbinding machine showing a next step in the operation of the bookbinding machine to the step shown in FIGS. 9A and 9B.
Figure 10B:
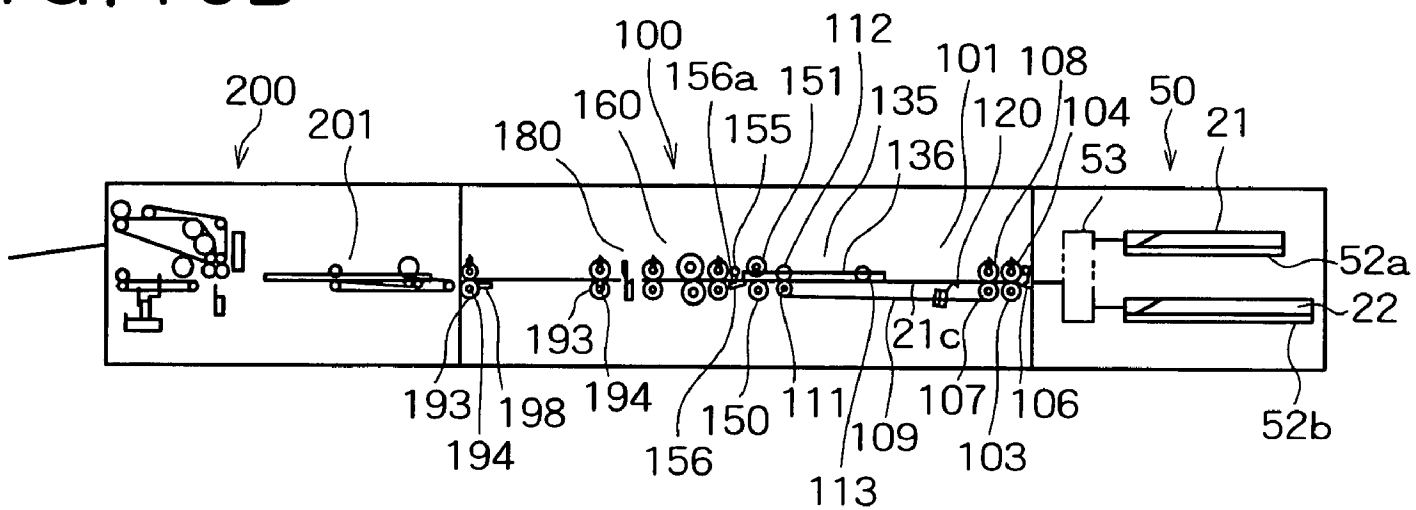

As shown in FIGS. 10A and 10B, as the motor 116 is driven, the rotation of the rotary shaft of the motor 166 is transmitted to the belt 191, thus rotating the rollers 193 and 195 to feed the sheet 21*d* toward the sheet discharge port 199. Based on the information input through the operation panel 186 beforehand, the control section 185 determines the supplied sheet of paper is a monochromatic print sheet which does not require a margin cutting process and creasing process (SCC step) or a color print sheet which needs the SCC step. The control section 185 identifies the sheet 21*d* as a monochromatic print sheet which does not need the SCC step, and activates only the conveying section 101 and does not activate the sheet aligning section 135, the slitting section 160, the cutting section 180 and the creasing section 190. Accordingly, the sheet 21*d* does not undergo the SCC step.

Then, the sheet 21*d* is discharged from the prebinding apparatus 100 through the sheet discharge port 199 and is supplied to the bookbinding apparatus 200. Meanwhile, the next monochromatic print sheet 21 is fed out from the sheet feeding shelf 52*a*, and a monochromatic image is formed on the top surface of the monochromatic print sheet 21 by the image forming section 53. As a result, the monochromatic print sheet 21 becomes the fourth monochromatic print sheet 21*c*. This monochromatic print sheet 21*c* is supplied to the position of the sheet aligning section 135 in the prebinding apparatus 100. As the control section 185 likewise identifies the sheet 21*c* as a monochromatic print sheet, the sheet 21*c* does not undergo the SCC step.

Figure 11A:
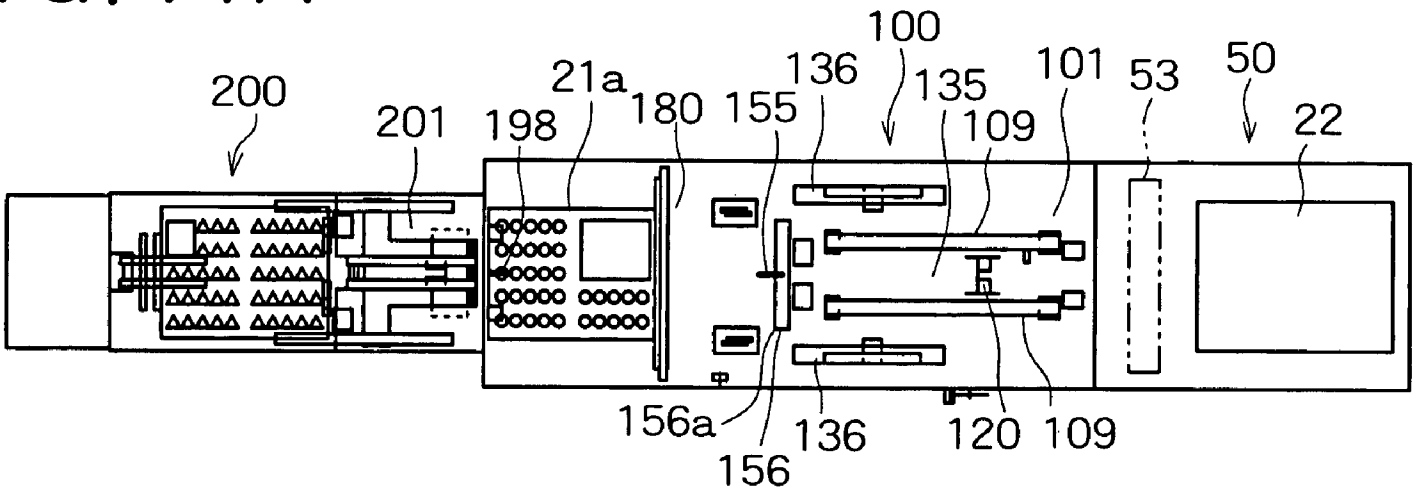
FIGS. 11A and 11B are a plan view and a side view of the bookbinding machine showing a next step in the operation of the bookbinding machine to the step shown in FIGS. 10A and 10B.
Figure 11B:
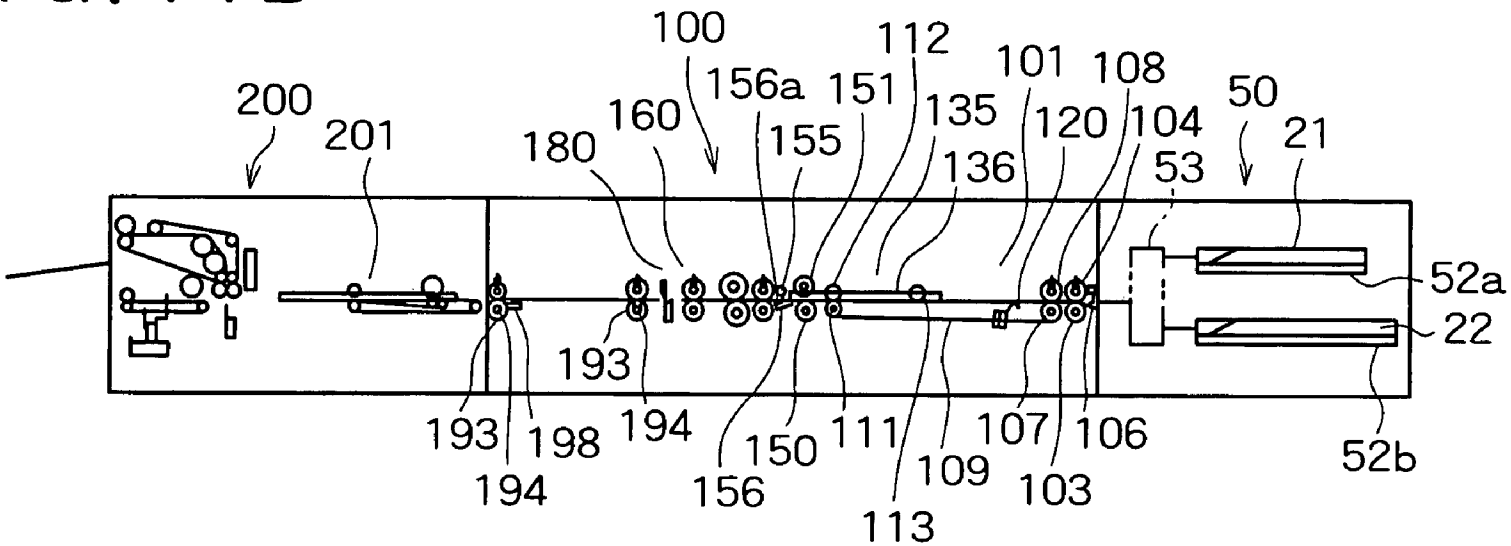

Next, as shown in FIGS. 11A and 11B, the sheets 21*d* and 21*c* are stacked on the sheet stacking/aligning section 201 of the bookbinding apparatus 200, and the monochromatic print sheets 21*b* and 21*a* are prepared in order by the image forming section 53, and supplied to the bookbinding apparatus 200 passing through the prebinding apparatus 100 to be stacked on the sheet stacking/aligning section 201 in order. At this time, in the sheet stacking/aligning section 201, the saddle stitch stopper 254 is lifted up to be intervened in the feeding path, so that the leading edges of the sheets 21*d* to 21*a* abut on the saddle stitch stopper 254 and the sheets 21 stop. Accordingly, the edges of the sheets 21*d* to 21*a* are aligned. The monochromatic print sheets 21*b* and 21*a* do not undergo the SCC step either. After the monochromatic print sheet 21*a* is discharged from the prebinding apparatus 100, the control section 185 identifies the next sheet to be supplied is a color print sheet 22 which needs the SCC step, moves the side guides 136 of the sheet aligning section 135 closer to the center and moves the slitters 161 of the slitting section 160 closer to the center.

Figure 12A:
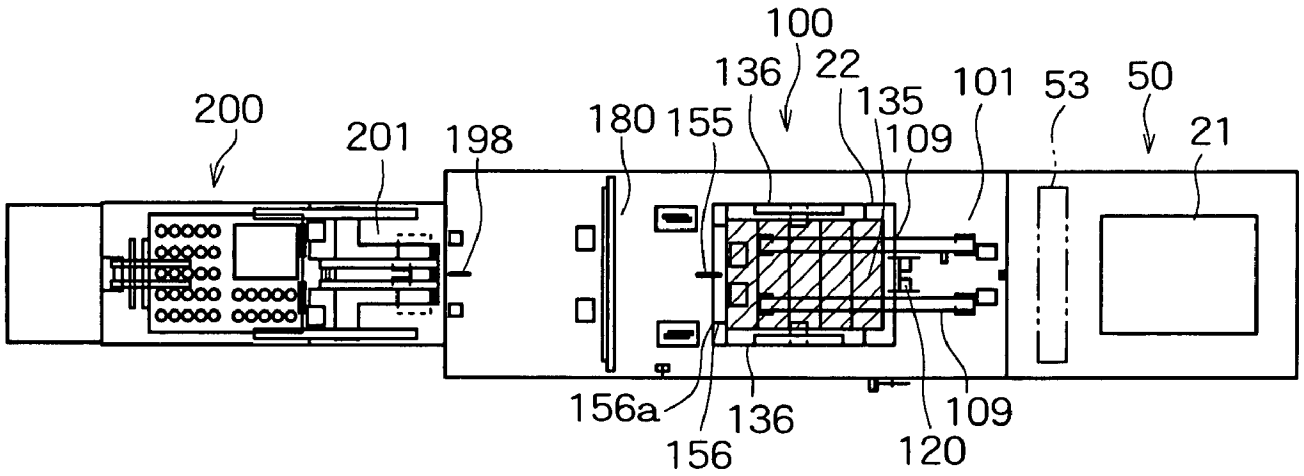
FIGS. 12A and 12B are a plan view and a side view of the bookbinding machine showing a next step in the operation of the bookbinding machine to the step shown in FIGS. 11A and 11B.
Figure 12B:
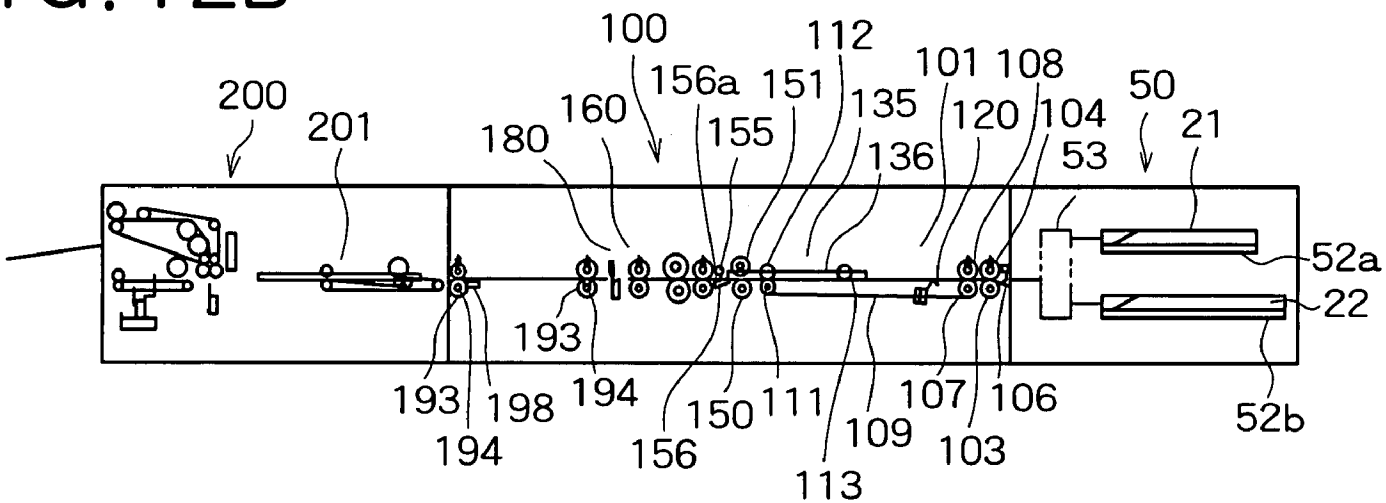

Next, as shown in FIGS. 12A and 12B, a single color print sheet 22 is fed out from the sheet feeding shelf 52*b*, and a color image is formed on the top surface of the color print sheet 22 by the image forming section 53. Then, the color print sheet 22 is supplied to the prebinding apparatus 100. As the control section 185 of the prebinding apparatus 100 identifies that the supplied sheet is a color print sheet which needs the SCC step, the control section 185 activates the sheet aligning section 135, the slitting section 160, the cutting section 180 and the creasing section 190 in response to the operation of the conveying section 101.

Specifically, the sheet-front-end aligning device 134 causes the distal end portion, 156*a*ÿ of the stopper 156 to be intervened in the sheet feeding path, and causes the leading edge of the color print sheet 22 to abut on the distal end portion 156*a*, and the back jogger 120 of the sheet-rear-end aligning device 132 presses the trailing edge of the sheet 22 toward the feeding direction 115, thereby adjusting the position of the sheet 22 in the feeding direction 115. The side guides 136 of the sheet-side aligning device 133 press the sheet 22 toward the widthwise-directional center to adjust the widthwise-directional position of the sheet 22.

Figure 13A:
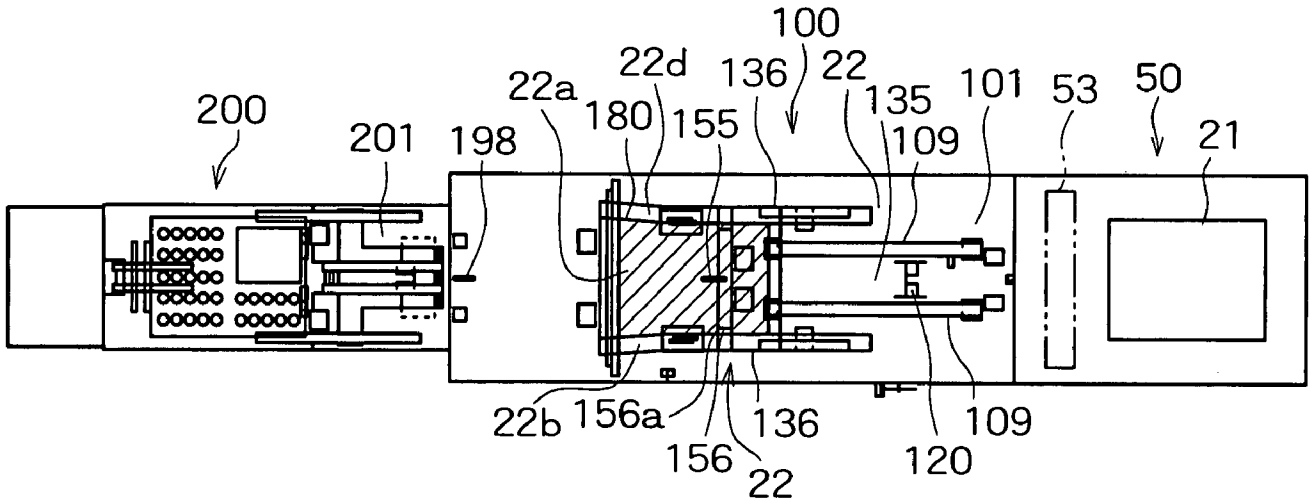
FIGS. 13A and 13B are a plan view and a side view of the bookbinding machine showing a next step in the operation of the bookbinding machine to the step shown in FIGS. 12A and 12B.
Figure 13B:
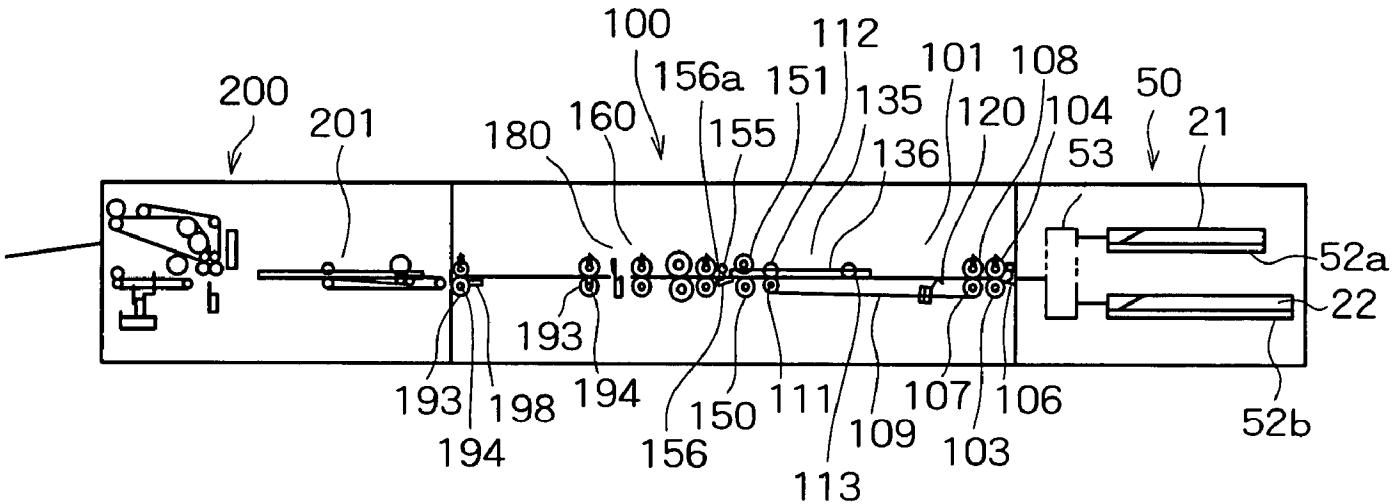

Next, as shown in FIGS. 13A and 13B, the distal end portion 156*a* of the stopper 156 is retreated from the sheet feeding path, and the driven roller 151 is set in contact with the feed roller 150. In the slitting section 160, as the motor 166 is driven to rotate the belts 167 and 168 and rotate the cutters 161*a* and 161*b* of each slitter 161, the sheet 22 is cut along the feeding direction 115 to remove the edge portions of both side portions of the sheet 22 or the margins 22*b* and 22*d* while being fed. Then, the sheet 22 is fed so that the boundary between the top margin 22*c* of the sheet 22 and the print area 22*a* is positioned at the cutting section 180. As the upper blade 182 of the cutting section 180 is moved downward in that state, the sheet 22 is cut along the widthwise direction to remove the margin 22*c* of the sheet 22. Thereafter, the driven roller 151 is separated from the feed roller 150 at the proper timing.

Figure 14A:
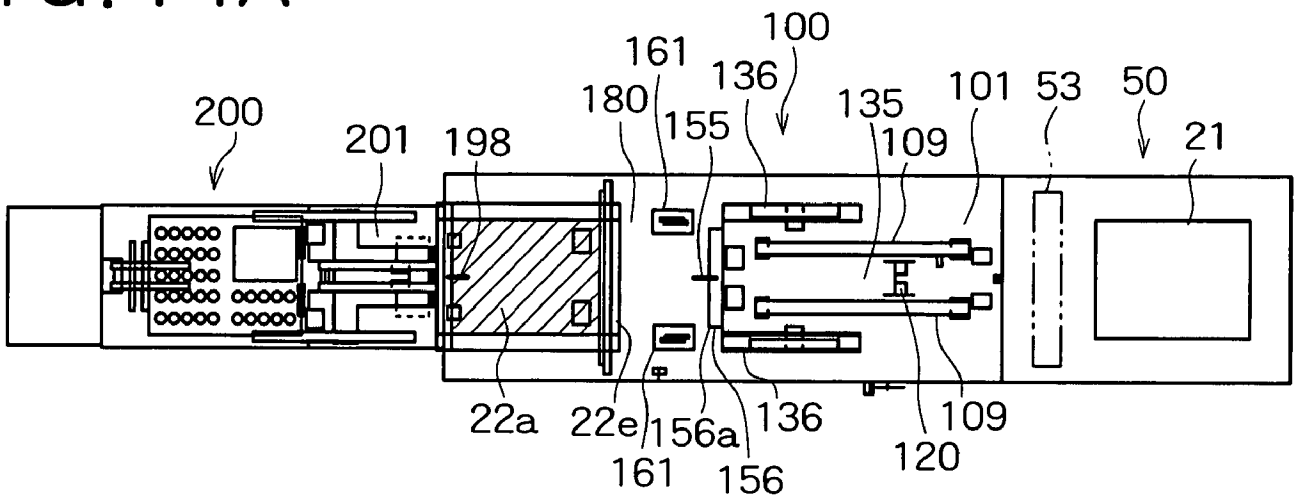
FIGS. 14A and 14B are a plan view and a side view of the bookbinding machine showing a next step in the operation of the bookbinding machine to the step shown in FIGS. 13A and 13B.
Figure 14B:
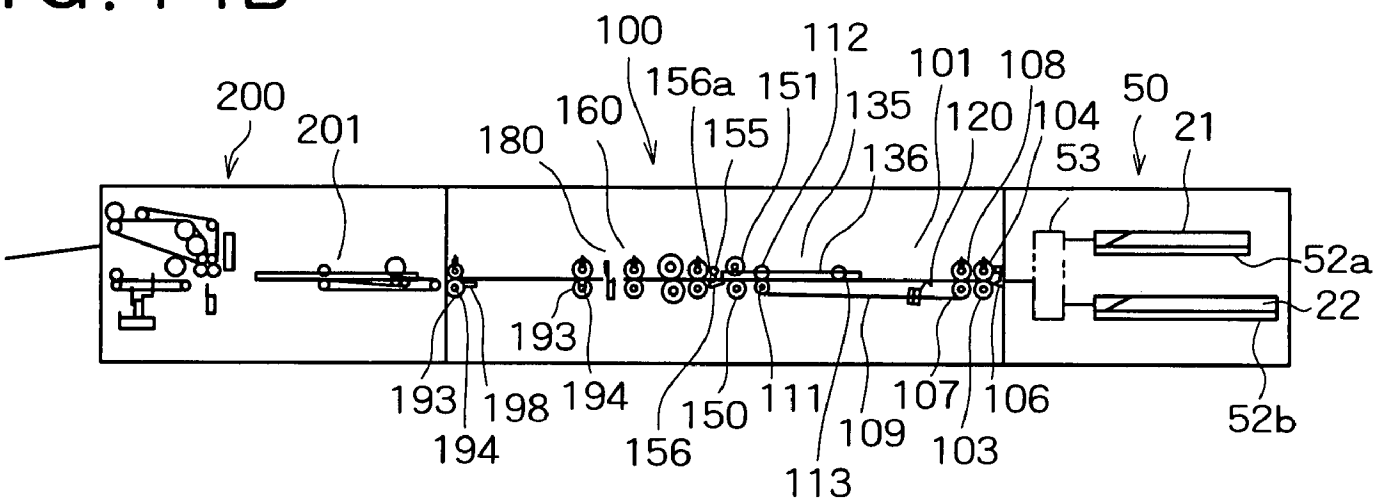

Next, as shown in FIGS. 14A and 14B, as the motor 166 is driven to rotate the belt 191, the sheet 22 is fed downstream and the boundary between the print area 22*a* of the sheet and margin 22*e* at the trailing edge portion is positioned at the cutting section 180. As the upper blade 182 of the cutting section 180 is moved downward in that state, the sheet 22 is cut along the widthwise direction to remove the bottom margin 22*e* of the sheet 22. As a result, the size of the sheet 22 becomes the bookbinding size equal to the size of the sheet 21.

Figure 15A:
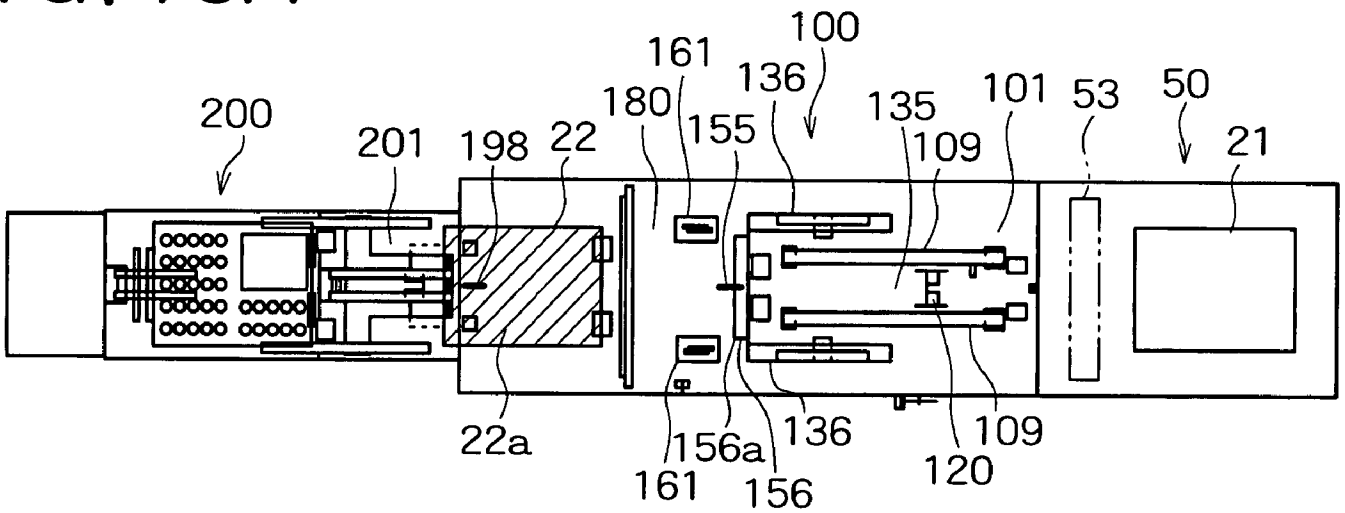
FIGS. 15A and 15B are a plan view and a side view of the bookbinding machine showing a next step in the operation of the bookbinding machine to the step shown in FIGS. 14A and 14B.
Figure 15B:
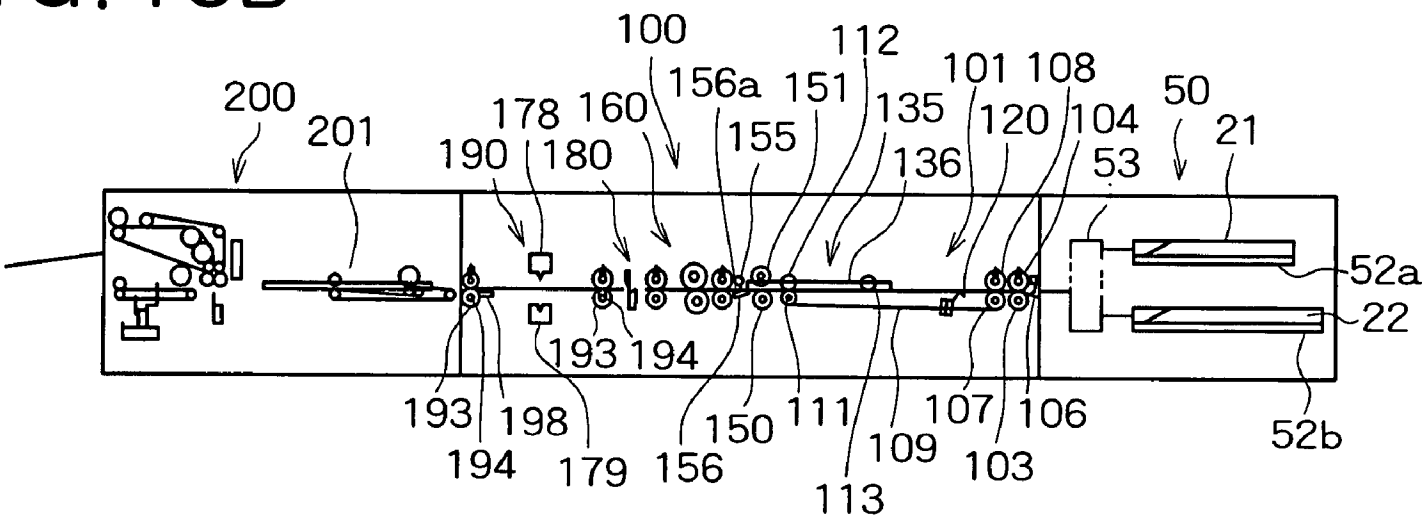

Next, as shown in FIGS. 15A and 15B, the motor 166 rotates the belt 191 to set the feeding-directional center portion of the sheet 22 at the position of the creasing section 190. Then, the eccentric roller 177 of the creasing section 190 is rotated to move the projection member 178 downward, so that the protruding portion of the projection member 178 is fitted in the recess portion of the recess member 179 with the sheet 22 in between, thereby creasing the feeding-directional center portion of the sheet 22.

Figure 16A:
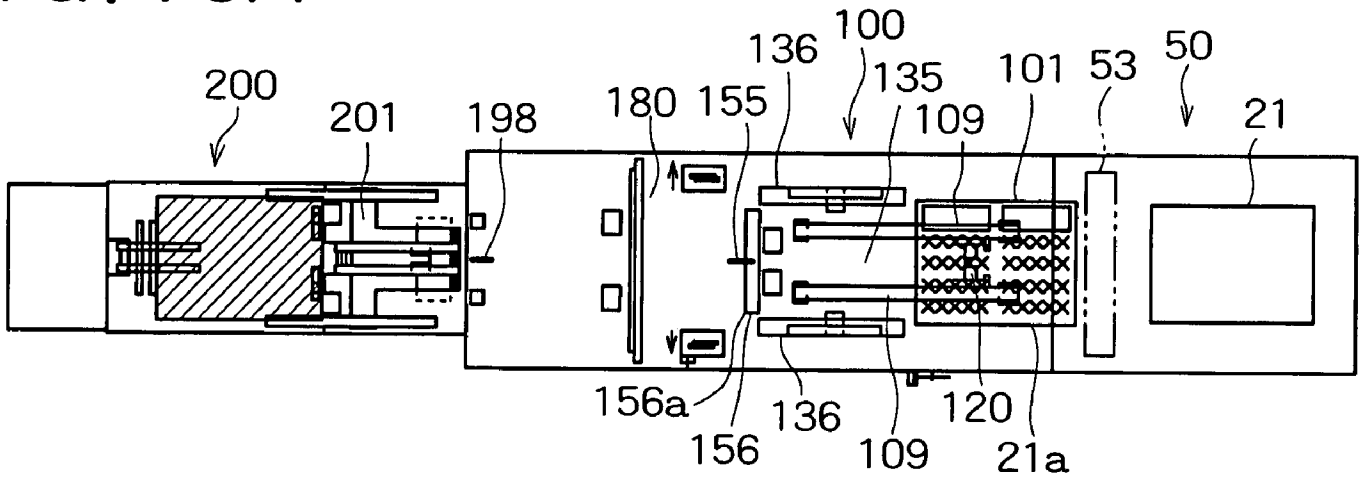
FIGS. 16A and 16B are a plan view and a side view of the bookbinding machine showing a next step in the operation of the bookbinding machine to the step shown in FIGS. 15A and 15B.
Figure 16B:
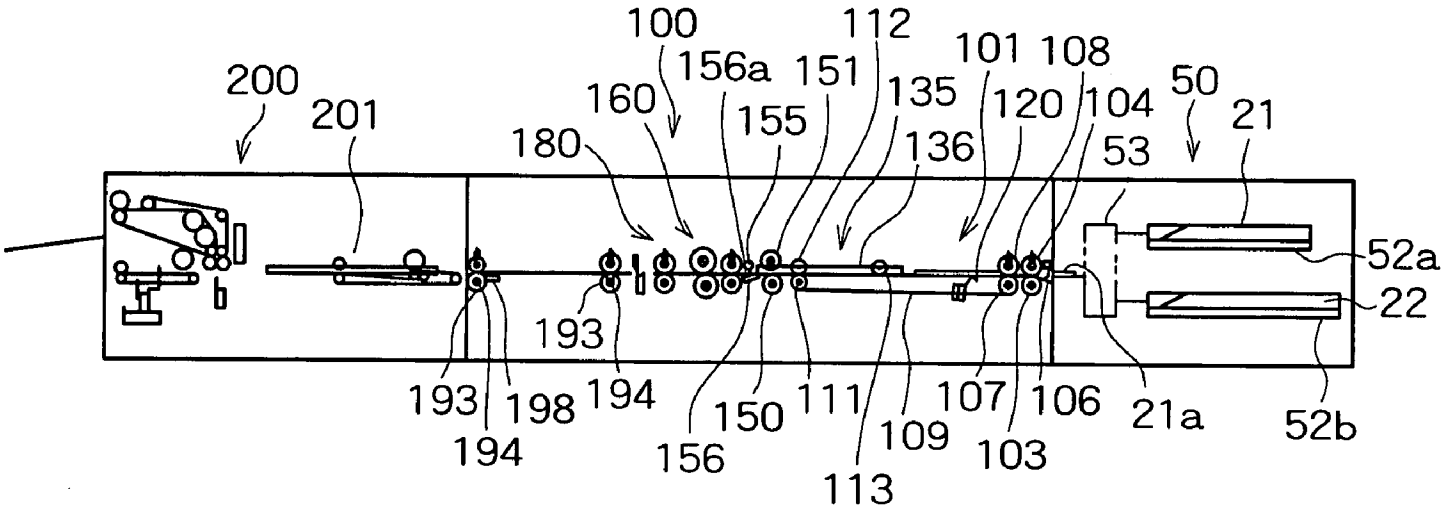

Next, as shown in FIGS. 16A and 16B, as the belt 191 is rotated, the sheet 22 is discharged from the prebinding apparatus 100 through the sheet discharge port 199 and is supplied to the bookbinding apparatus 200 through the sheet inlet port 202. Then, the belt 203 conveys the sheet 22 until it abuts on the saddle stitch stopper 254 after which sheet feeding is stopped. Accordingly, the monochromatic print sheets 21*d*, 21*c*, 21*b* and 21*a* and the color print sheet 22 are stacked on the belt 203 in order from the bottom at the sheet stacking/aligning section 201 the bookbinding apparatus 200. Meanwhile, the slitters 161 and the side guides 136 of the prebinding apparatus 100 are moved outward in the widthwise direction after the sheet 22 passes.

Next, as shown in FIG. 1, in the stitch section 230 of the bookbinding apparatus 200, the stitcher 231 connects and stitches the monochromatic print sheets 21*d* to 21*a* and the color print sheet 22 stacked on the belt 203. Then, the saddle stitch stopper 254 is moved downward and out of the sheet feeding path, and the crease stopper 255 is moved upward to be intervened in the feeding path. Next, the belts 203 and 257 are rotated to feed the sheets 21 and 22 connected together in the feeding direction 115 until they abut on the crease stopper 255. At this time, the feeding-directional center portions of the sheets are positioned directly above the folding knife 251 of the folding section 250.

Next, the folding knife 251 is moved upward to lift up the feeding-directional center portions of the sheets. Then, the folding rollers 252 and 253 hold the lifted-up portions of the sheets and pull them upward. As a result, the sheets are folded to prepare a booklet 23 (see FIG. 7B). Next, the conveying section 260 conveys the booklet 23 to the discharge port 269 and discharges the booklet 23 onto the tray 270 outside the bookbinding apparatus 200 through the discharge port 269. This completes bookbinding of the booklet 23.

According to the embodiment, the image forming apparatus 50, the prebinding apparatus 100 and the bookbinding apparatus 200 are connected together on line and sheets of paper supplied to the sheet feeding section 51 of the image forming apparatus 50 continuously pass the image forming apparatus 50, the prebinding apparatus 100 and the bookbinding apparatus 200 in the named order. This makes it unnecessary for a worker to carry sheets of paper between the image forming apparatus 50 and the prebinding apparatus 100, and between the prebinding apparatus 100 and the bookbinding apparatus 200. This increases the processing speed and improves the bookbinding efficiency. With the on-line connection, the image forming apparatus 50, the prebinding apparatus 100 and the bookbinding apparatus 200 can perform processes in parallel. At the time of binding a plurality of booklets, the processes for the individual booklets can be carried out overlapping one another, thereby making the processing time shorter. The processes for the individual booklets should not necessarily be overlapped.

The control section 185 of the prebinding apparatus 100 sorts image-formed sheets of paper into color print sheets which need the margin-cutting process and creasing process (SCC step) and monochromatic print sheets which do not need the SCC step. Based on the sorting result, the control section 185 controls the operations of the conveying section 101, the slitting section 160, the cutting section 180 and the creasing section 190 to perform the margin-cutting process and creasing process only on color print sheets and directly pass monochromatic print sheets through the prebinding apparatus 100. This further improves the binding efficiency. As information can be input to the control section 185 beforehand through the operation panel 186 and the bookbinding machine can be operated based on the information, an automatic operation is possible.

Further, as the image forming apparatus 50, the prebinding apparatus 100 and the bookbinding apparatus 200 can be operated systematically according to the embodiment, the operational burden is reduced and the bookbinding efficiency is improved. As the sheet feeding section 51 of the image forming apparatus 50 are provided with two sheet feeding shelves 52*a* and 52*b* and monochromatic print sheets can be supplied to the sheet feeding shelf 52*a* and color print sheets can be supplied to the sheet feeding shelf 52*b*, two types of sheets can be supplied separately, thus facilitating supply of sheets.

Although the cutting section 180 is constituted by a cutter comprised of the lower blade 181 and the upper blade 182 in the embodiment, the cutting section 180 may be constituted as a roll cutter or so. Although sorting of sheets into cutting-needed sheets of paper which need margin cutting and/or creasing and non-cutting-needed sheets of paper which do not need margin cutting and/or creasing is carried out based on information input through the operation panel 186 the illustrated embodiment, sorting of sheets into cutting-needed sheets of paper and non-cutting-needed sheets of paper may be carried out based on print information input from the image forming apparatus 50 which indicates whether monochromatic printing or color printing has been done. Alternately, sorting of sheets into cutting-needed sheets of paper and non-cutting-needed sheets of paper may be carried out based on size information of sheets to be stacked on the two sheet feeding shelves 52*a* and 52*b* provided at the sheet feeding section 51. Further, one sheet feeding shelf 52*a* in the two sheet feeding shelves 52*a* and 52*b* may be designated as a sheet feeding shelf for the color printing size while the other sheet feeding shelf 52*b* may be designated as a sheet feeding shelf for the monochromatic printing size, and sorting of sheets into cutting-needed sheets of paper and non-cutting-needed sheets of paper may be carried out based on information from the sheet feeding shelf from which sheets have been supplied. Although the sheet 22 is creased by the creasing section 190 after the boundary between the print area 22*a* of the sheet 22 and the margin 22*e* at the trailing edge portion is cut in the embodiment, the sheet 22 may be creased by the creasing section 190 before the boundary between the print area 22*a* of the sheet 22 and the margin 22*e* at the trailing edge portion is cut.

Figure 17:
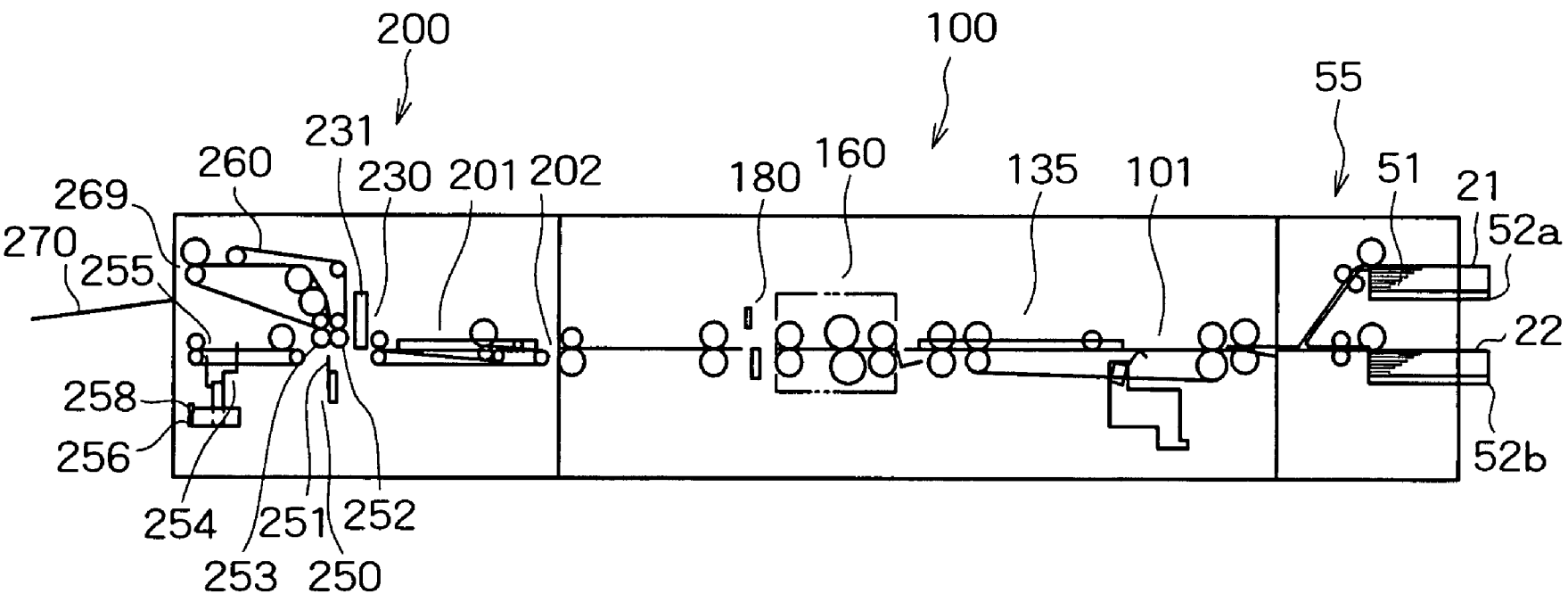
FIG. 17 is a side view illustrating a bookbinding machine according to a modification of the first embodiment of the invention.

A modification of the first embodiment will be discussed next. FIG. 17 is a side view illustrating a bookbinding machine according to the modification. The modification differs from the first embodiment in that a sheet feeder 55 is provided in place of the image forming apparatus 50. The sheet feeder 55 is provided with the sheet feeding section 51 provided with two sheet feeding shelves 52*a* and 52*b*. An image forming section is not provided at the sheet feeder 55. In the modification, the bookbinding machine does not form images and supplies image-formed sheets of paper having images already formed thereon to the sheet feeding section 51. For example, a monochromatic print sheet having a monochromatic image formed on the top surface is supplied to the sheet feeding shelf 52*a* and a color print sheet having a color image formed on the top surface is supplied to the sheet feeding shelf 52*b*. The other structure, operation and effects of the modification are the same as those of the first embodiment.

Figure 18:
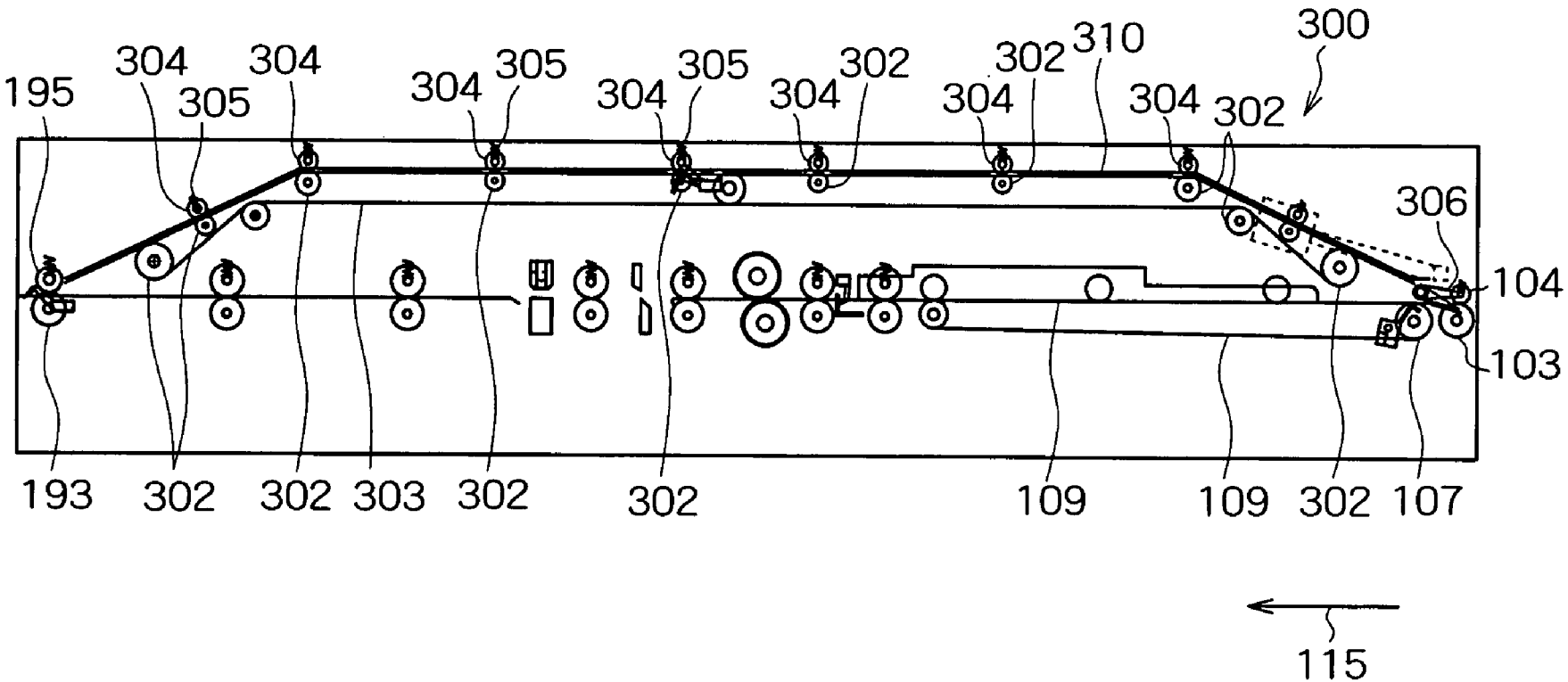
FIG. 18 is a side view illustrating a prebinding apparatus according to a second embodiment of the invention.

The second embodiment will be discussed below. FIG. 18 is a side view illustrating a prebinding apparatus according to the second embodiment. As shown in FIG. 18, a prebinding apparatus 300 according to the embodiment has bypass section 301 provided between the sheet feed port 176 and the sheet discharge port 199. The bypass section 301 serves to feed a sheet, supplied to the sheet feed port 176, to the sheet discharge port 199 bypassing the sheet aligning section 135, the slitting section 160, the cutting section 180 and the creasing section 190. The image forming apparatus 50 (see FIG. 1) or the sheet feeder 55 (see FIG. 17) is provided at the upstream of the prebinding apparatus 300, and the bookbinding apparatus 200 (see FIG. 1) is provided at the downstream of the prebinding apparatus 30.

As shown in FIG. 18, the bypass section 301 is provided with a plurality of rollers 302 over which a belt 303 is tightly stretched, thereby forming a belt conveyor. Rollers 304 are provided above some of the rollers 302, and are urged toward the belt 303 by a spring 305 so that the rollers 304 roll in contact with the belt 303. Accordingly, space between the belt 303 and the rollers 304 forms a sheet bypass path 310. The belt-driven roller 108 (see FIG. 1) is not provided above the belt drive roller 107 in the conveying section 101, but a changeover lever 306 as feeding-path changing section is provided instead. The changeover lever 306 is rotatably supported between a feeding path 110 formed by the conveyance belt 109 and the bypass path 310 formed by the bypass section 301. As the changeover lever 306, when rocked, changes the feeding path of a sheet of paper supplied through the sheet feed port 176 either to the feeding path 110 or the bypass path 310. The bypass section 301 supplies a sheet having passed the bypass path 310 to between the feed rollers 193 and the driven rollers 195 located at the downmost position in the prebinding apparatus 300. The other structure of the embodiment is the same as that of the first embodiment.

The operation of the bookbinding machine according to the second embodiment with the above-described structure will be discussed. In the embodiment, the control section 185 (see FIG. 1) sorts a supplied sheet of paper into a color print sheet 22 which needs the SCC step or a monochromatic print sheet 21 which does not need the SCC step based on previously input information. As the changeover lever 306 is rocked based on the sorting result, the color print sheet 22 is supplied to the feeding path 110, and the monochromatic print sheet 21 to the bypass path 310. Accordingly, the color print sheet 22 supplied to the feeding path 110 is subjected to the SCC step in an operation similar to the one done in the first embodiment, and is then supplied to the bookbinding apparatus 200. The monochromatic print sheet 21 supplied to the bypass path 310 bypasses the sheet aligning section 135, the slitting section 160, the cutting section 180 and the creasing section 190, and is supplied to the bookbinding apparatus 200 without undergoing the SCC step. The other operation of the embodiment is the same as that of the first embodiment.

In the embodiment, the prebinding apparatus 300 is provided with the bypass section 301 and the changeover lever 306 which changes the feeding path of a supplied sheet either toward the feeding path 110 or the bypass path 310. While the bypass path 310 is conveying the monochromatic print sheet 21, the color print sheet 22 can undergo the SCC step in the feeding path 110. As a result, the monochromatic print sheet 21 and the color print sheet 22 can be processed in parallel, further improving the processing efficiency. The other effects of the embodiment are the same as those of the first embodiment.

Figure 19A:
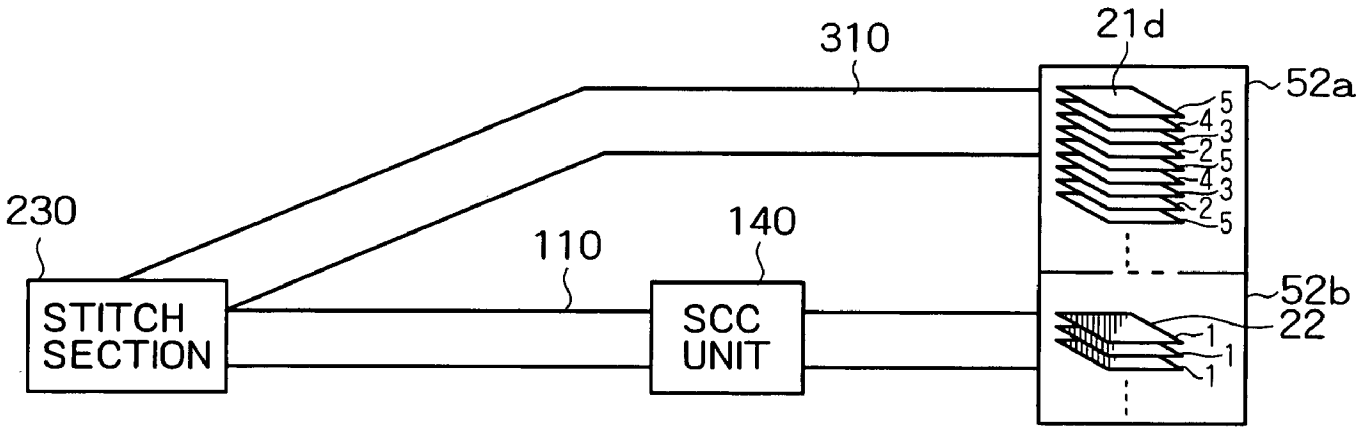
FIGS. 19A and 19B are diagrams showing one step in the first operation pattern according to a third embodiment of the invention.

The third embodiment of the invention will be described below. FIGS. 19A and 19B, FIGS. 20A and 20B, FIGS. 21A and 21B and FIG. 22 are diagrams showing the first operation pattern according to the embodiment step by step, and FIGS. 23A and 23B, FIGS. 24A and 24B, FIGS. 25A and 25B and FIGS. 26A and 26B are diagrams showing the second operation pattern according to the embodiment step by step. As shown in FIG. 19A, in the embodiment, the sheet feeder is provided with two sheet feeding shelves 52*a* and 52*b* and two sheet discharge ports which are directly connected to the respective sheet feeding shelves. A prebinding apparatus is provided with two sheet feed ports, which correspond to the sheet feeding shelves of the sheet feeder and are connected to the respective sheet feeding shelves of the sheet feeder. The sheet feed port of the prebinding apparatus which is connected to the sheet feeding shelf 52*a* of the sheet feeder is connected to the bypass path 310, and the sheet feed port of the prebinding apparatus which is connected to the sheet feeding shelf 52*b* of the sheet feeder is connected to the feeding path 110. That is, the sheet feeder serves as the feeding-path changing section of the prebinding apparatus in the embodiment.

For the sake of simplicity, in FIGS. 19 to 26, the sheet aligning section 135, the slitting section 160, the cutting section 180 and the creasing section 190 shown in FIG. 1 are illustrated as an SCC unit 140, and only the SCC unit 140, the feeding path 110 and the bypass path 310 are illustrated in the prebinding apparatus, while the stitch section 230 alone or only the stitch section 230 and the folding section 250 are illustrated in the bookbinding apparatus. For the sake of convenience, page numbers indicating the stack positions at the stitch section 230 are affixed to the sheets 21 and 22. For example, "5" affixed to the monochromatic print sheet 21*d* indicates the sheet is the fifth sheet stacked from the top at the stitch section 230. As the monochromatic print sheet 21*d* is stacked fifth from the top at the stitch section 230, "sheet 21*d* (fifth)" is written. Likewise, "sheet 21*c* (fourth)" is written for the sheet 21*c* to be stacked fourth from the top at the stitch section 230, "sheet 21*b* (third)" is written for the sheet 21*c* to be stacked third from the top at the stitch section 230, "sheet 21*a* (second)" is written for the sheet 21*c* to be stacked second from the top at the stitch section 230, and "sheet 22 (first)" is written for the color print sheet 22 to be stacked at the top at the stitch section 230.

The first operation pattern will be described below. In the operation pattern, a booklet is prepared from four monochromatic print sheets 21*a* to 21*d* and a single color print sheet 22 as per the first embodiment. As shown in FIG. 19A, the monochromatic print sheets 21 have been supplied to the sheet feeding shelf 52*a*, and the color print sheets 22 have been supplied to the sheet feeding shelf 52*b*. The monochromatic print sheets 21 are stacked on the sheet feeding shelf 52*a* in the order of the sheet 21*d* (fifth), the sheet 21*c* (fourth), the sheet 21*b* (third), the sheet 21*a* (second), the sheet 21*d* (fifth), the sheet 21*c* (fourth), the sheet 21*b* (third), the sheet 21*a* (second), and so forth from the top.

Figure 19B:
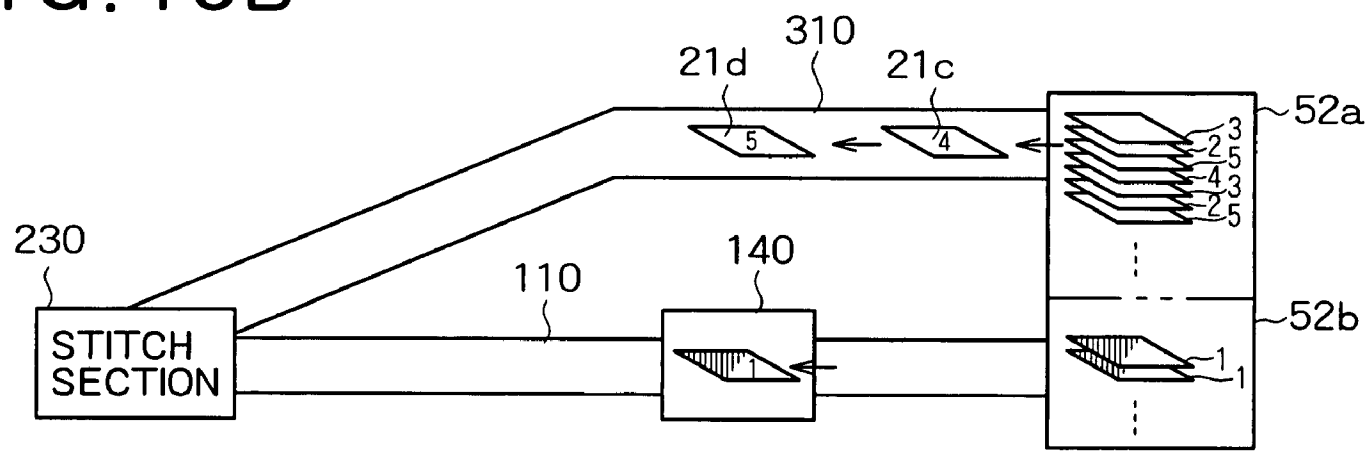

As shown in FIG. 19B, the monochromatic print sheet 21*d* to be stacked fifth from the top at the stitch section 230 and the monochromatic print sheet 21*c* (fourth) to be stacked fourth from the top are sequentially supplied to the bypass path 310 from the sheet feeding shelf 52*a*, and the color print sheet 22 is supplied to the feeding path 110 from the sheet feeding shelf 52*b*. The color print sheet 22 is to be stacked at the top at stitch section 230.

Figure 20A:
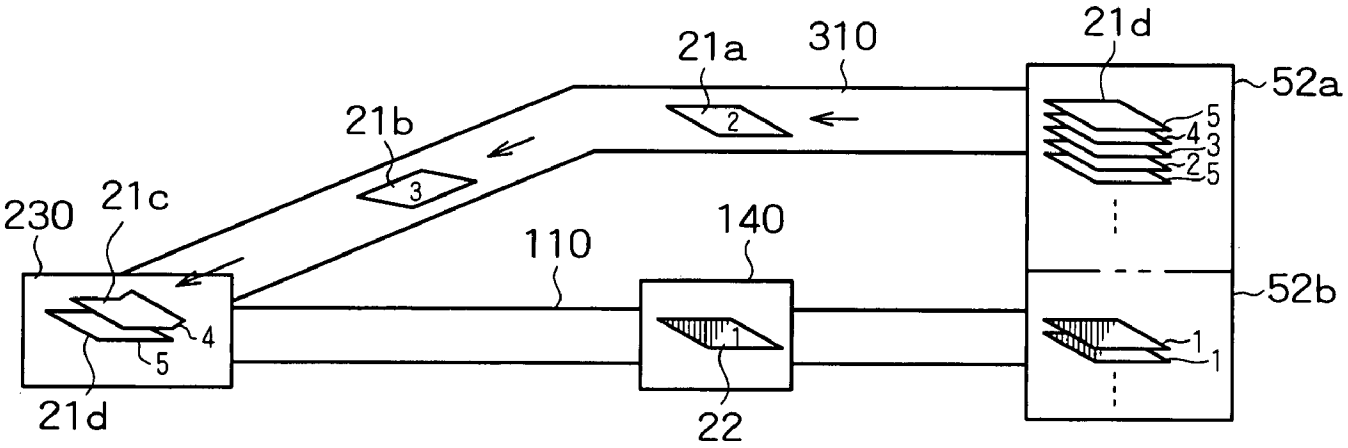
FIGS. 20A and 20B are diagrams showing a next step in the first operation pattern according to the embodiment to the step shown in FIG. 19B.
Figure 20B:
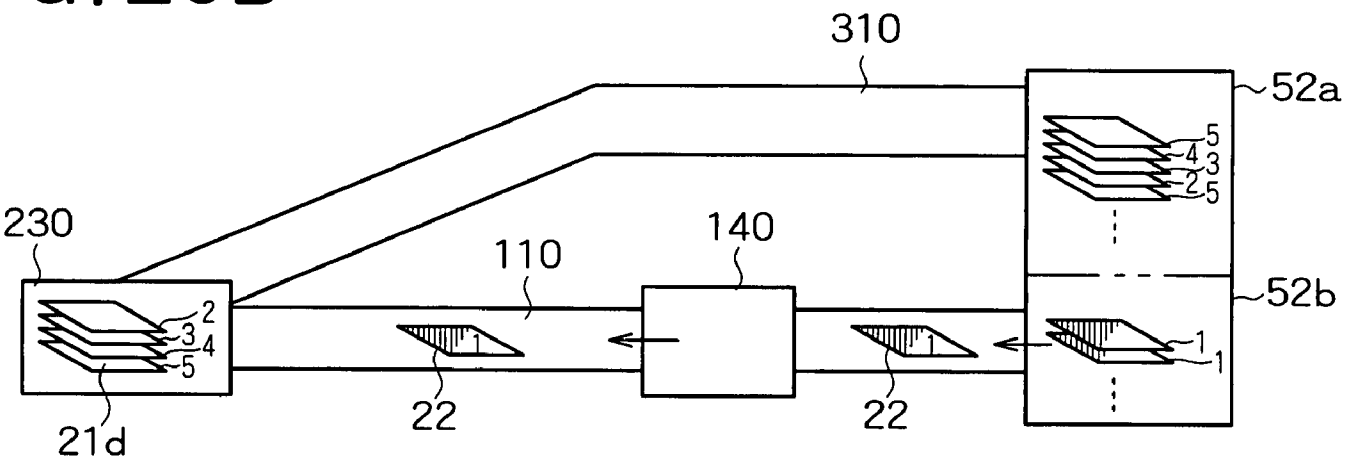

As shown in FIG. 20A, while the SCC unit 140 is performing the SCC step on the color print sheet 22 (first), the monochromatic print sheet 21*b* (third) and the monochromatic print sheet 21*a* (second) are sequentially supplied to the bypass path 310 from the sheet feeding shelf 52*a* to pass along the bypass path 310. Next, as shown in FIG. 20B, after processing of the color print sheet 22 (first) in the SCC unit 140 is finished, the color print sheet 22 is fed toward the stitch section 230 of the bookbinding apparatus 200, and a next color print sheet 22 is supplied to the SCC unit 140. At this time, the monochromatic print sheets 21*d* to 21*a* (fifth to second) have already been stacked at the stitch section 230, and the color print sheet 22 (first) whose SCC step has been completed is stacked on the stack of the monochromatic print sheets 21*d* to 21*a*. As a result, sheets for one booklet are stacked at the stitch section 230.

Figure 21A:
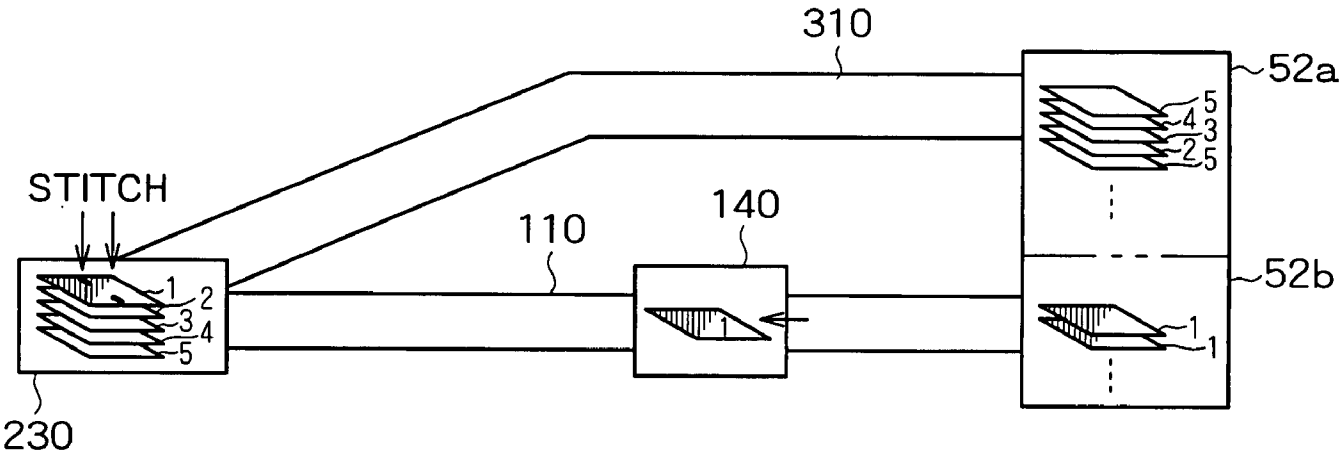
FIGS. 21A and 21B are diagrams showing a next step in the first operation pattern according to the embodiment to the step shown in FIG. 20B.
Figure 21B:
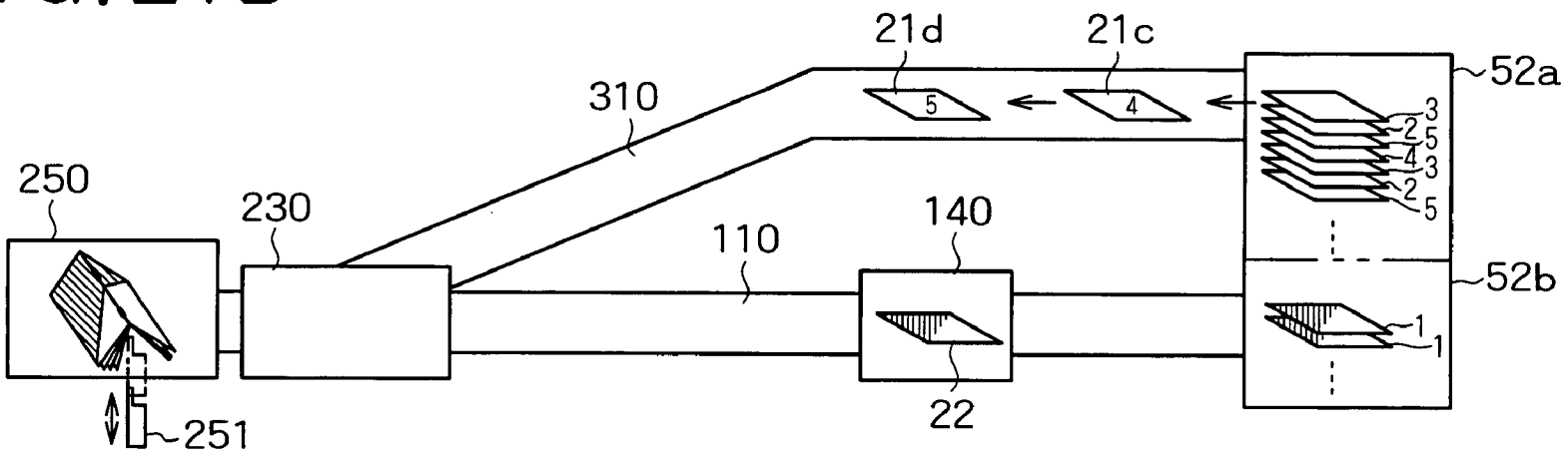

Next, as shown in FIG. 21A, while the SCC unit 140 is performing the SCC step on the second color print sheet 22, the stitch section 230 performs stitching of the first booklet. Next, as shown in FIG. 21B, while the SCC unit 140 is performing the SCC step on the second color print sheet 22, the monochromatic print sheets 21*d* (fifth) and 21*c* (fourth) are sequentially supplied to the bypass path 310 from the sheet feeding shelf 52*a*. The folding section 250 performs the folding process for the first booklet.

Figure 22:
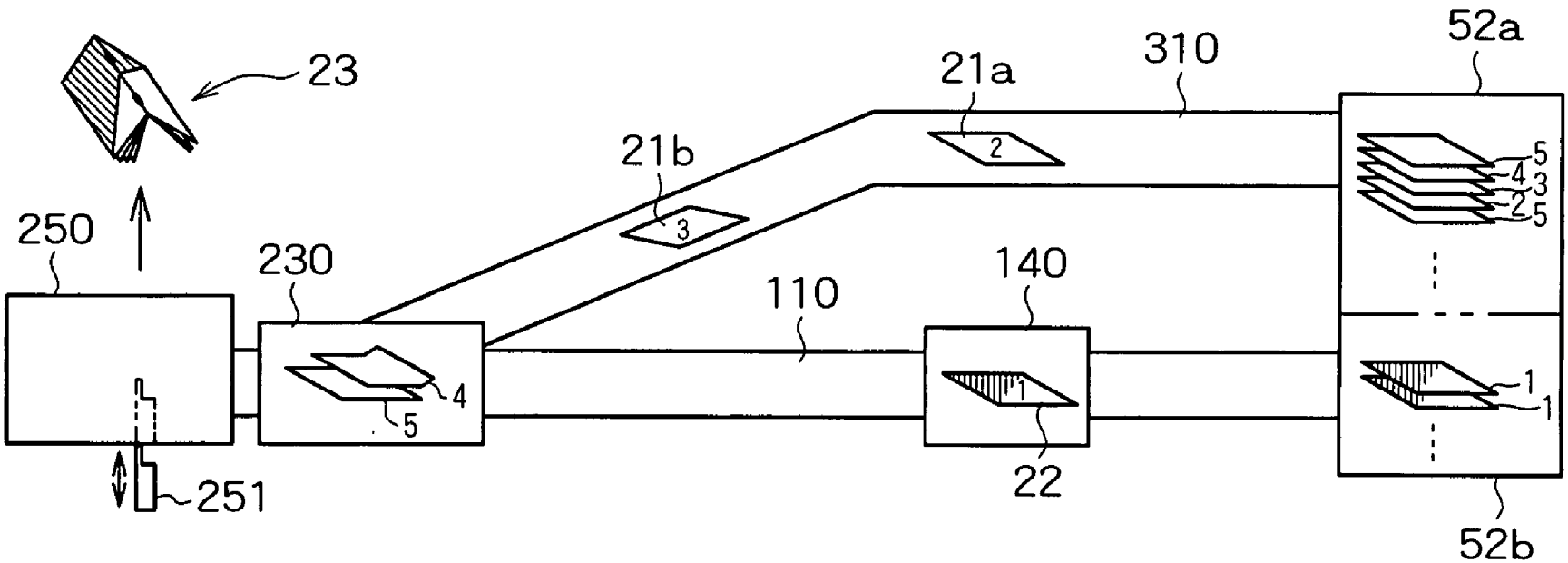
FIG. 22 is a diagram showing a next step in the first operation pattern according to the embodiment to the step shown in FIG. 21B.

Then, as shown in FIG. 22, the booklet 23 whose folding process has been completed is discharged out of the bookbinding machine. This completes binding of the first booklet. At this time, the monochromatic print sheets 21*d* (fifth) and 21*c* (fourth) for the second booklet have already been stacked at the stitch section 230, and the monochromatic print sheets 21*b* (third) and 21*a* (second) are passing in the bypass path 310 and the color print sheet 22 (first) is undergoing the SCC step in the SCC unit 140.

The second operation pattern will be described below. In the operation pattern, a booklet is prepared from three monochromatic print sheets 21*a* to 21*c* and two color print sheets 22*s* and 22*t*. For example, the color print sheet 22*s* is a color page constituting a spread page at the center of a booklet, and the color print sheet 22*t* is a color page constituting the top and back covers of the booklet. At this time, the color print sheets 22*s* and 22*t* are stacked at the top and at the fifth place from the top at the stitch section 230, and the monochromatic print sheets 21*a* to 21*c* are stacked at the second and fourth places from the top.

Figure 23A:
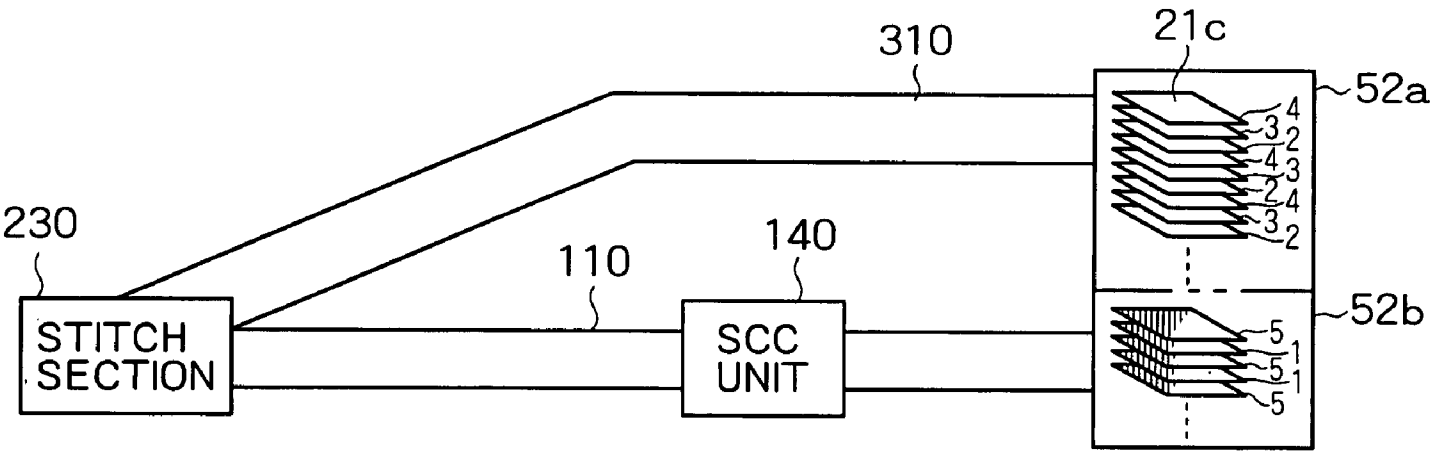
FIGS. 23A and 23B are diagrams showing one step in the second operation pattern according to the embodiment.

To begin with, as shown in FIG. 23A, the monochromatic print sheets 21 have been supplied to the sheet feeding shelf 52*a*, and the color print sheets 22 have been supplied to the sheet feeding shelf 52*b*. The monochromatic print sheets 21 are stacked on the sheet feeding shelf 52*a* in the order of the sheet 21*c* (fourth), the sheet 21*b* (third), the sheet 21*a* (second), the sheet 21*c* (fourth), the sheet 21*b* (third), the sheet 21*a* (second), and so forth from the top. The sheets 22*s* (fifth) and the sheets 22*t* (first) are alternately stacked on the sheet feeding shelf 52*b*.

Figure 23B:
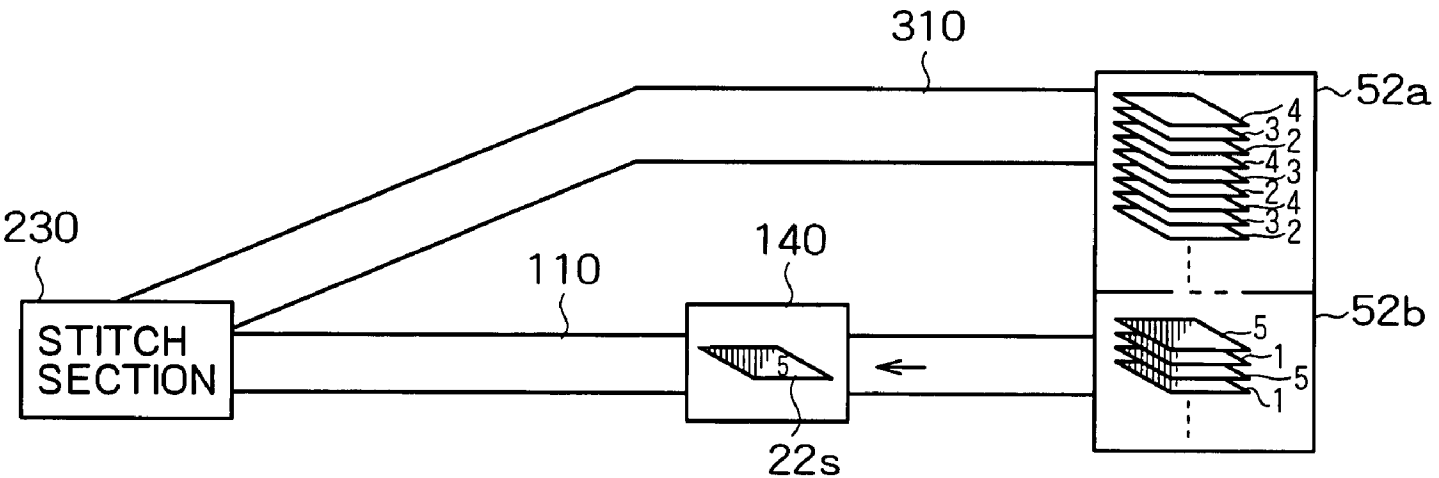

As shown in FIG. 23B, the color print sheet 22*s* (fifth) is supplied to the SCC unit 140 from the sheet feeding shelf 52*b*.

Figure 24A:
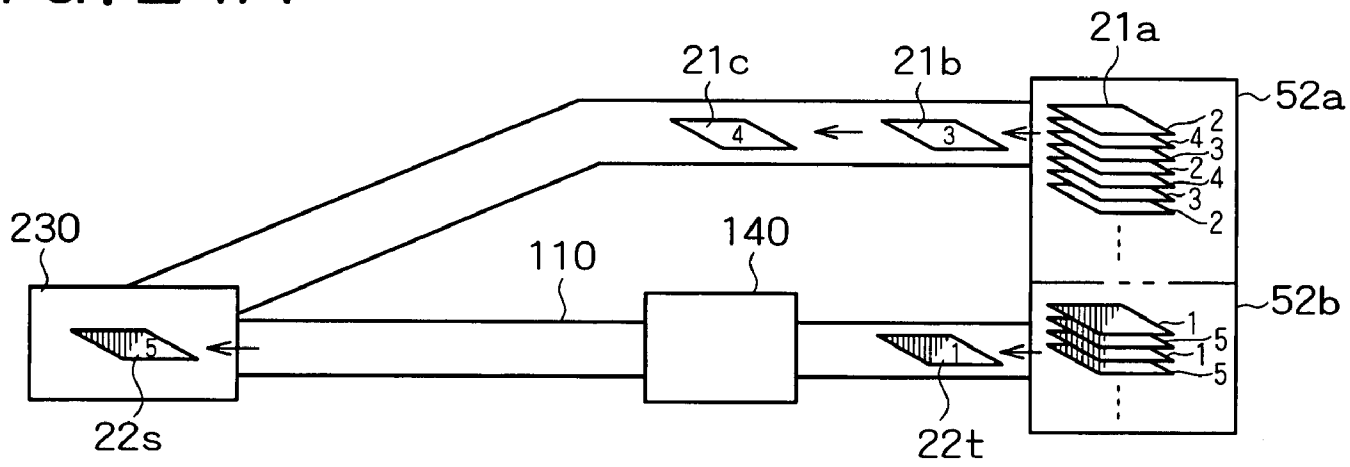
FIGS. 24A and 24B are diagrams showing a next step in the second operation pattern according to the embodiment to the step shown in FIG. 23B.

Next, as shown in FIG. 24A, the color print sheet 22*s* (fifth) is stacked at the stitch section 230 after its SCC step is completed. The monochromatic print sheets 21*c* (fourth) and 21*b* (third) are sequentially supplied to the bypass path 310 from the sheet feeding shelf 52*a*. The color print sheet 22*t* (first) is supplied to the feeding path 110.

Figure 24B:
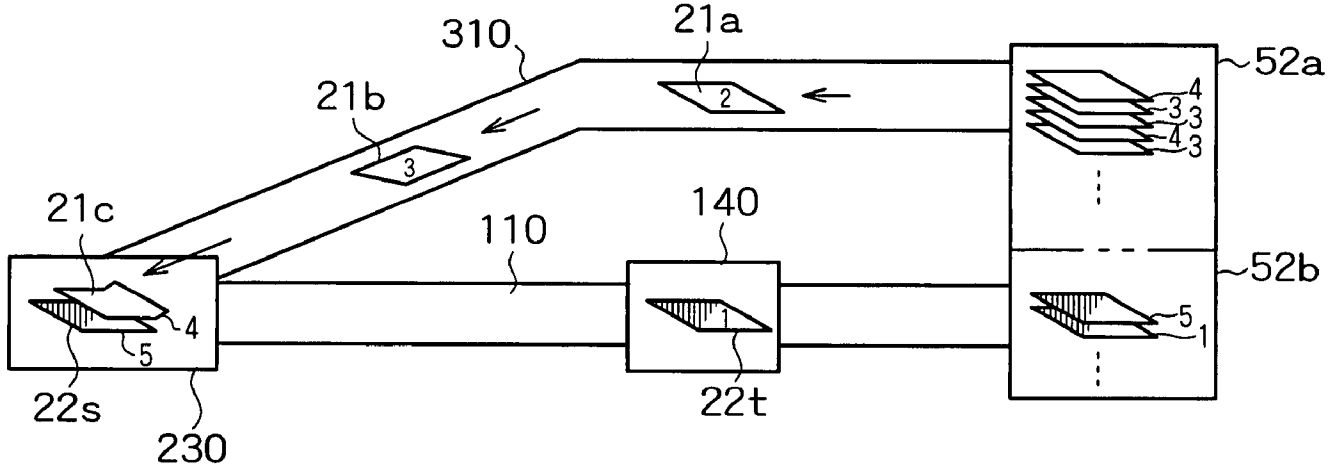

As shown in FIG. 24B, while the color print sheet 22*t* (first) is undergoing the SCC step in the SCC unit 140, the monochromatic print sheets 21*c* (fourth) and 21*b* (third) sequentially pass along the bypass path 310 to be stacked at the stitch section 230.

Figure 25A:
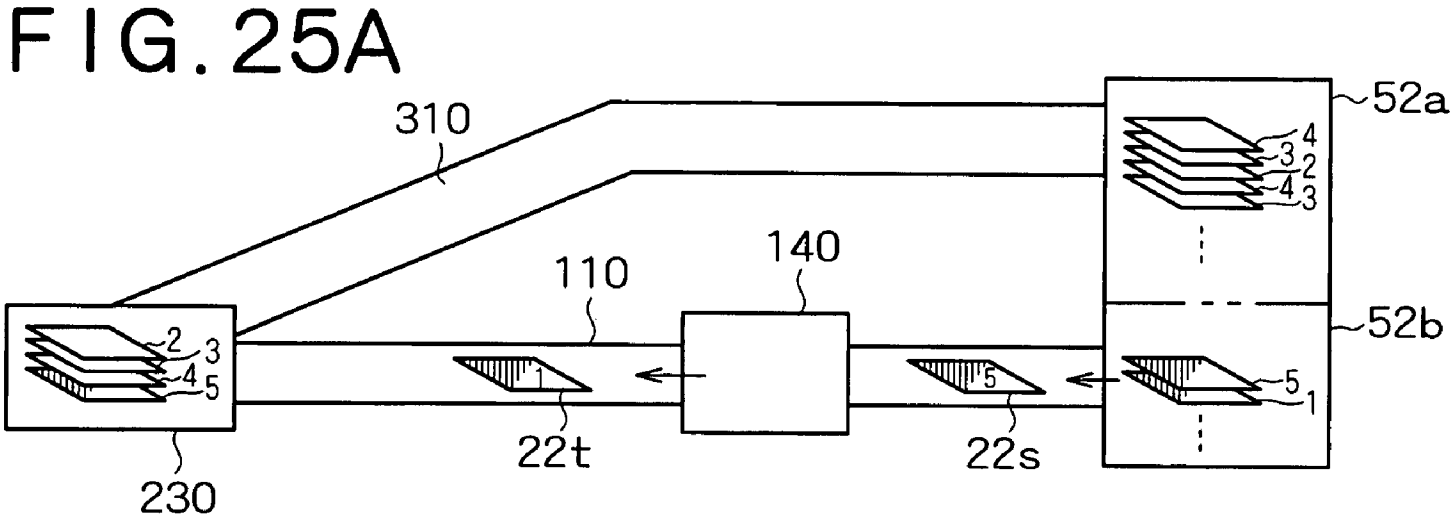
FIGS. 25A and 25B are diagrams showing a next step in the second operation pattern according to the embodiment to the step shown in FIG. 24B.

Next, as shown in FIG. 25A, after the SCC step of the color print sheet 22*t* (first) is finished, the color print sheet 22*t* (first) is fed toward the stitch section 230, and a next color print sheet 22*s* (fifth) for the second booklet is supplied to the SCC unit 140 and fed toward the SCC unit 140.

Figure 25B:
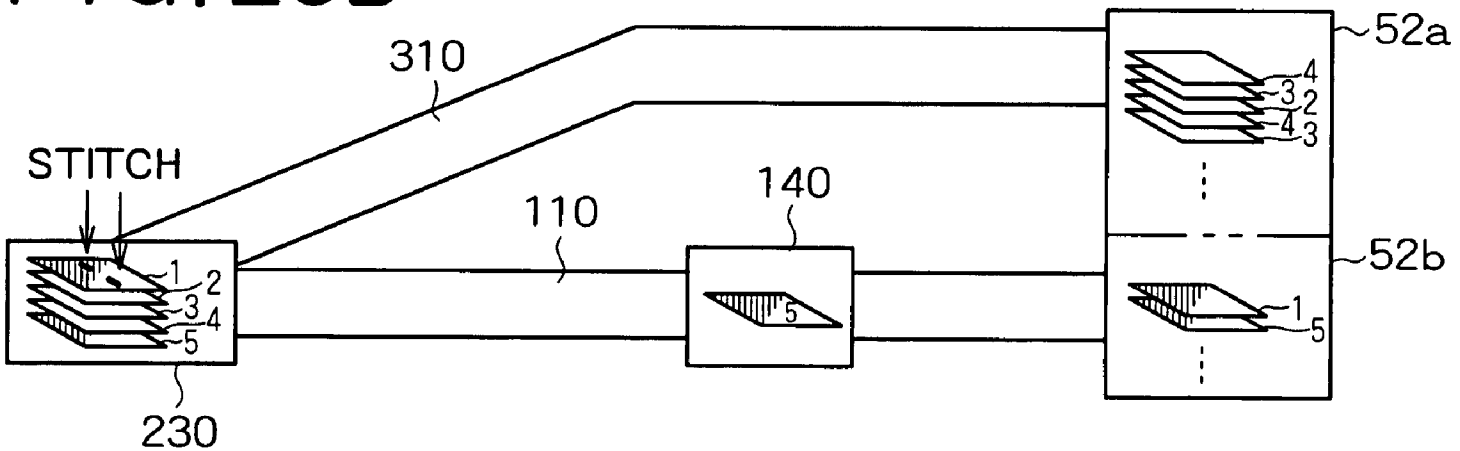

Next, as shown in FIG. 25B, while the color print sheet 22*s* (fifth) for the second booklet is undergoing the SCC step, the color print sheet 22*t* (first) for the first booklet reaches the stitch section 230 and undergoes the stitching process at the stitch section 230.

Figure 26A:
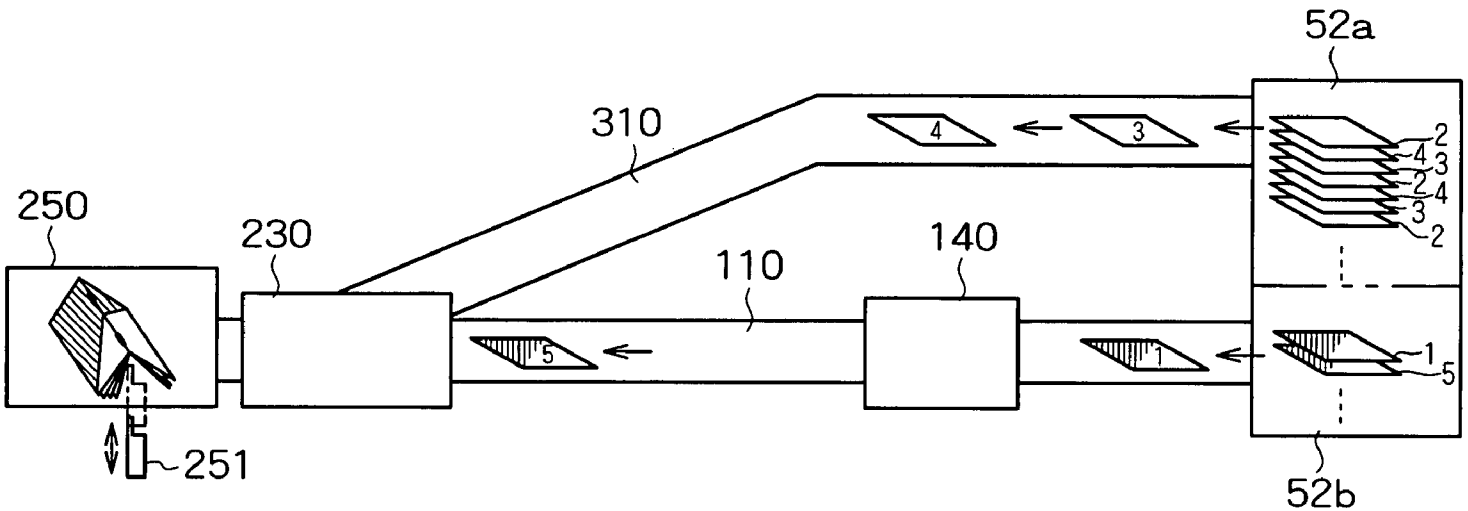
FIGS. 26A and 26B are diagrams showing a next step in the second operation pattern according to the embodiment to the step shown in FIG. 25B.

Next, as shown in FIG. 26A, the SCC step on the color print sheet 22*s* (fifth) of the second booklet is completed and fed toward the stitch section 230, and the folding process for the first booklet is executed.

Figure 26B:
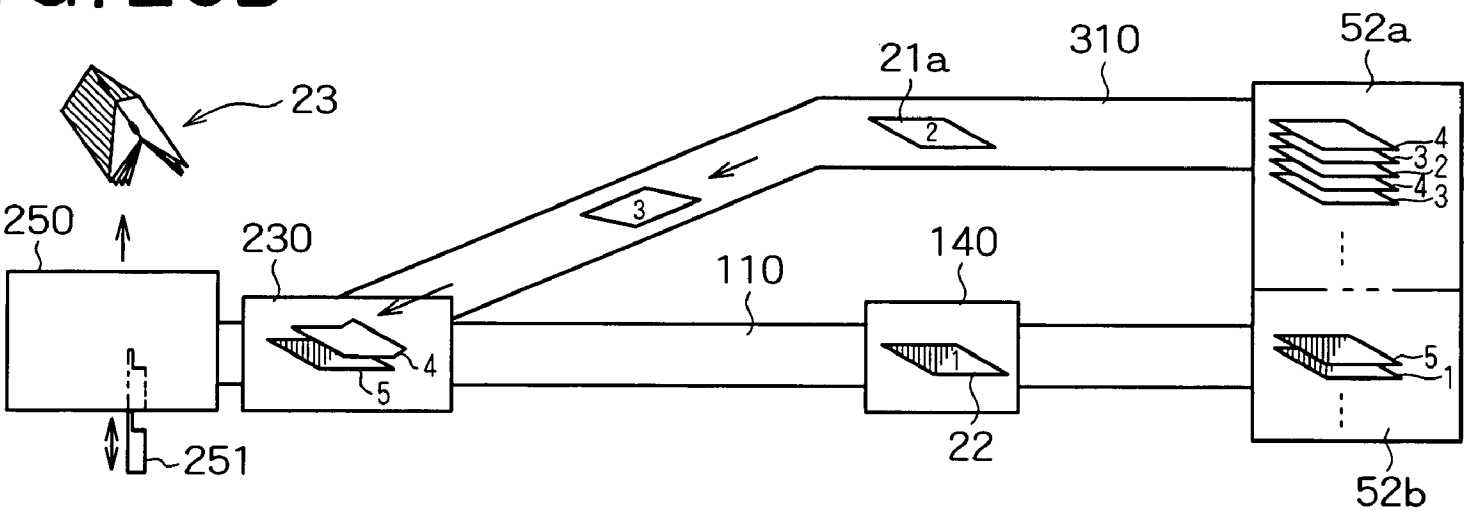

Then, as shown in FIG. 26B, the booklet 23 whose folding process has been completed is discharged out of the bookbinding machine. This completes binding of the first booklet. At this time, the color print sheet 22*s* (fifth) and the monochromatic print sheet 21*c* (fourth) for the second booklet have already been stacked at the stitch section 230, and the monochromatic print sheets 21*b* (third) and 21*a*

(second) are passing in the bypass path 310 and the color print sheet 22*t* (first) is undergoing the SCC step in the SCC unit 140.

As a monochromatic print sheet and a color print sheet can be processed in parallel according to the embodiment, the time needed for bookbinding can be shortened. The first and second operation patterns of the embodiment can be adapted to the second embodiment. The other structure, operation and effects of the modification are the same as those of the second embodiment.

Figure 27A:
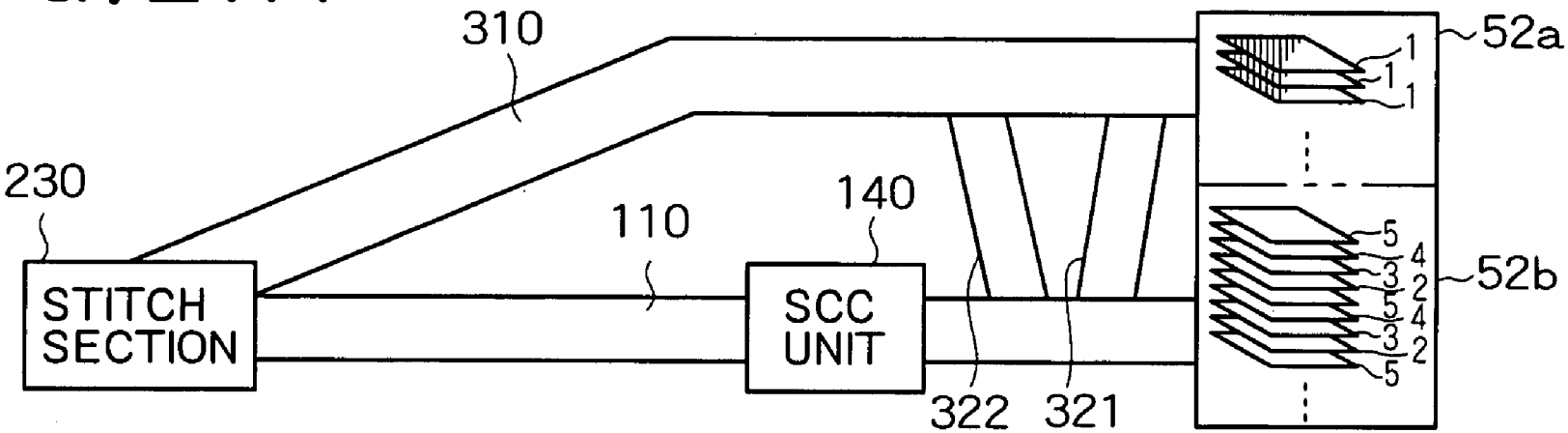
FIGS. 27A and 27B are diagrams showing one step in the operation pattern according to a fourth embodiment of the invention.
Figure 27B:
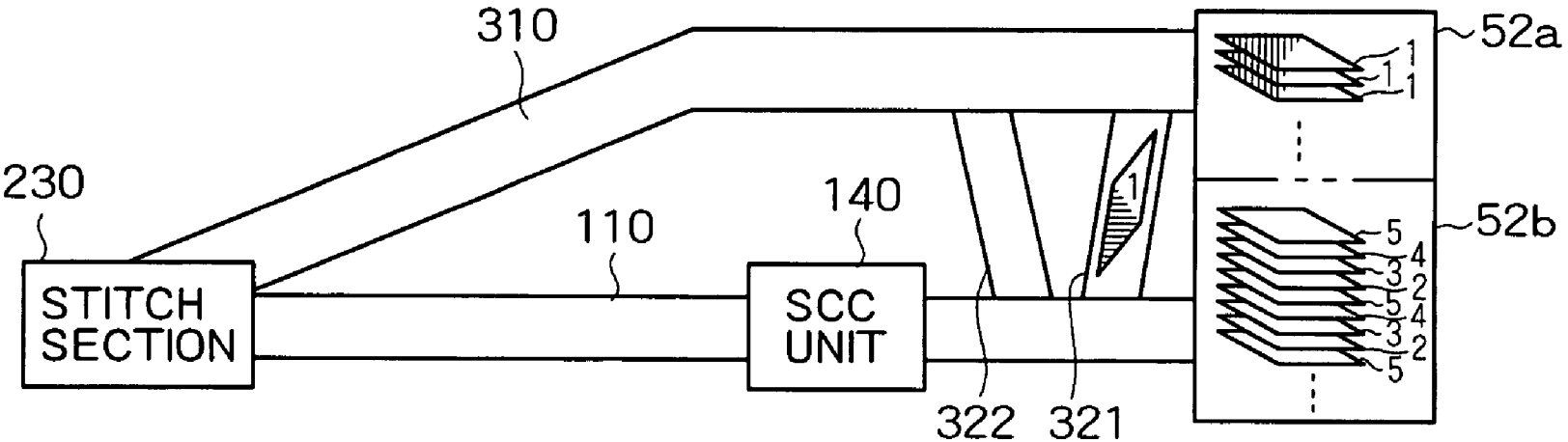
Figure 28A:
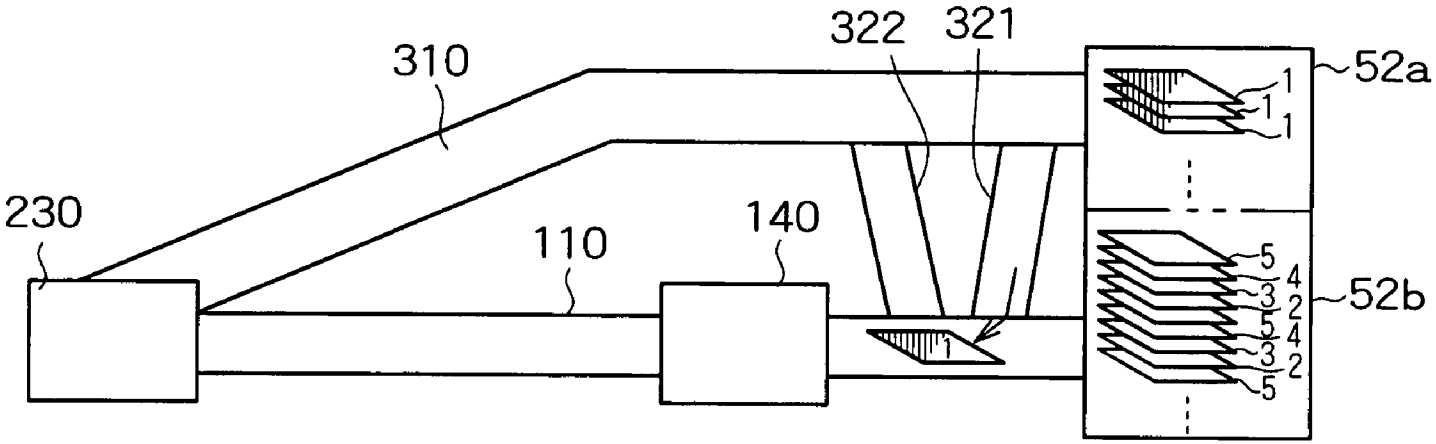
FIGS. 28A and 28B are diagrams showing a next step in the operation pattern according to the embodiment to the step shown in FIG. 27B.
Figure 28B:
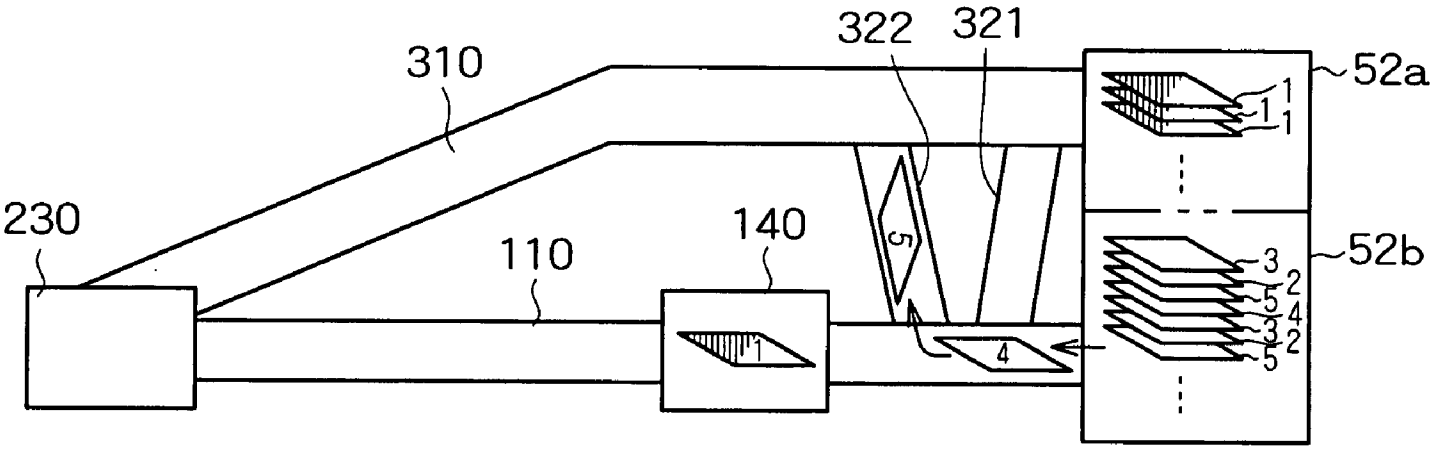
Figure 29A:
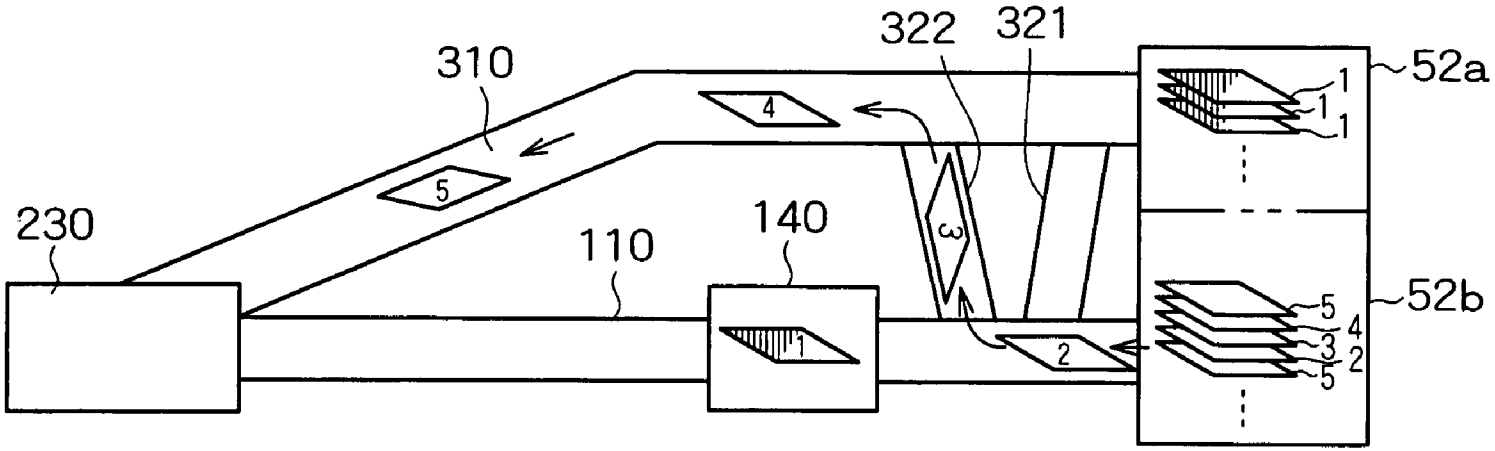
FIGS. 29A and 29B are diagrams showing a next step in the operation pattern according to the embodiment to the step shown in FIG. 28B.
Figure 29B:
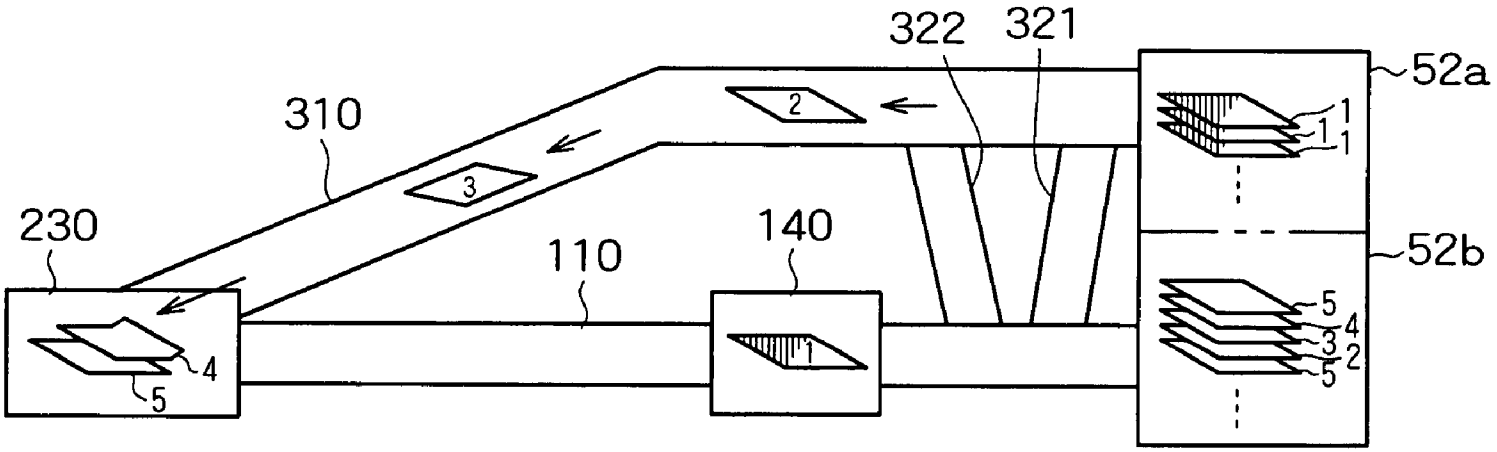
Figure 30A:
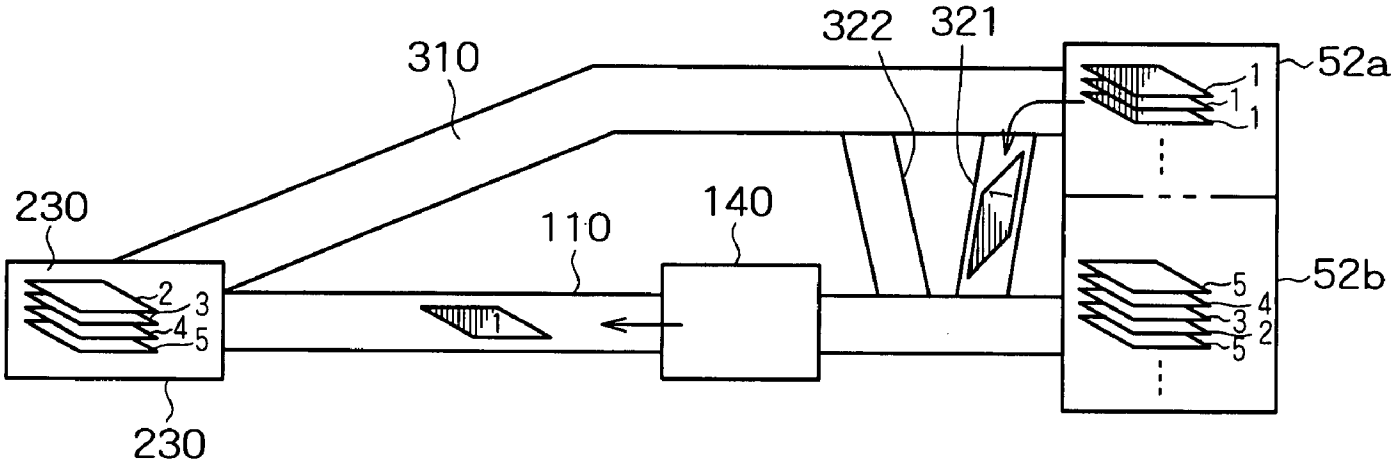
FIGS. 30A and 30B are diagrams showing a next step in the operation pattern according to the embodiment to the step shown in FIG. 29B.
Figure 30B:
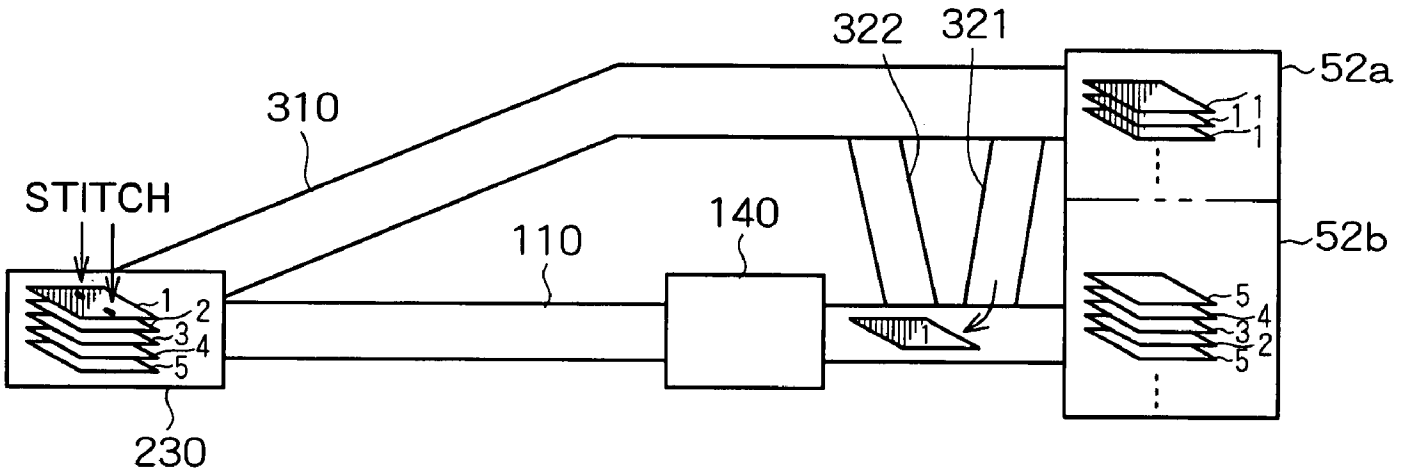
Figure 31A:
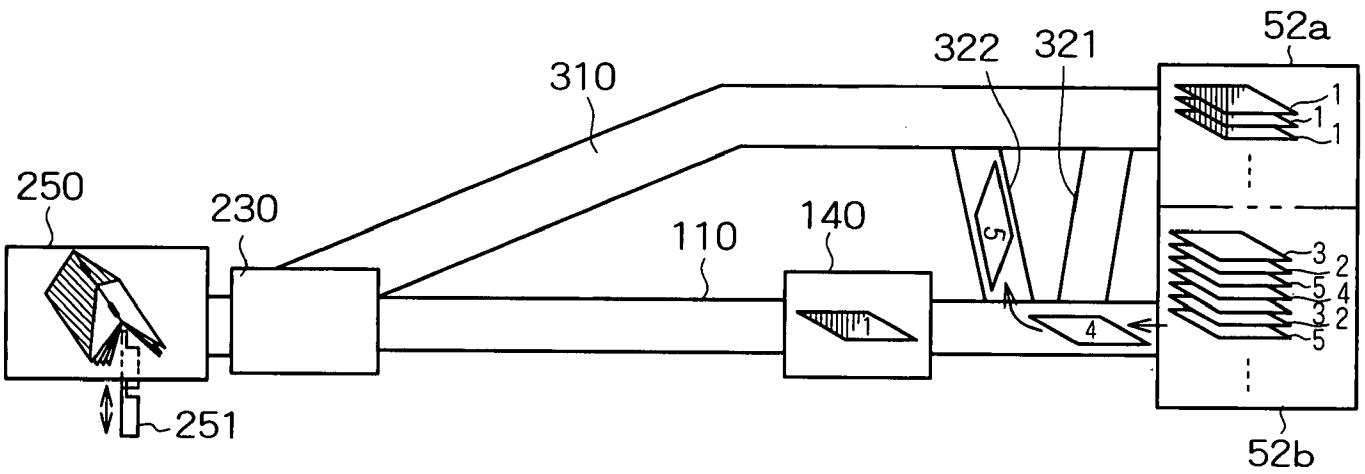
FIG. 31(A) and FIG. 31(B) are digrams showing a next step in the operation pattern according to the embodiment to the step shown in FIG. 30B.
Figure 31B:
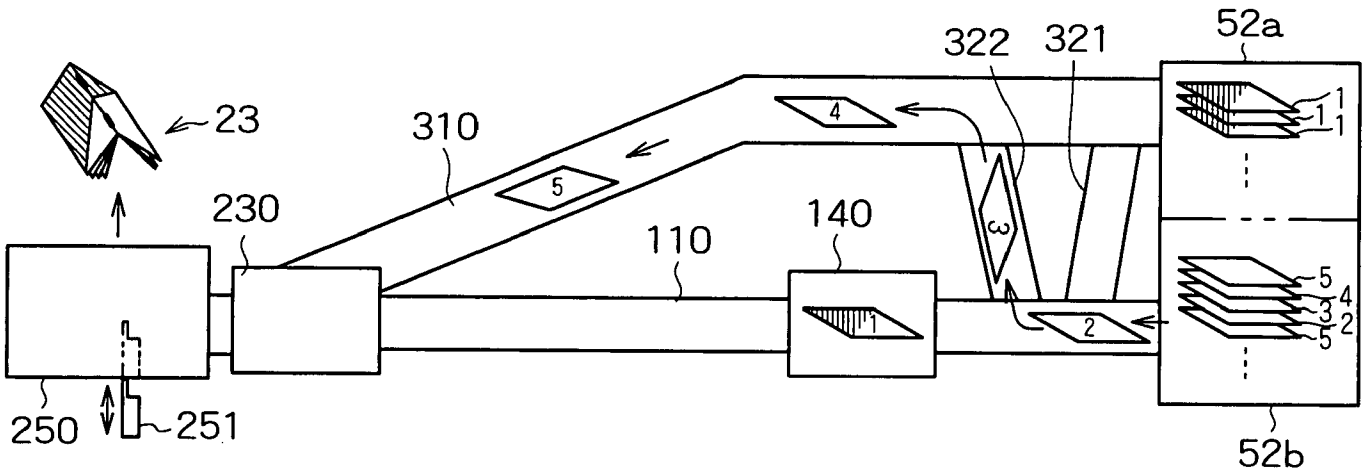

The fourth embodiment of the invention will be described below. FIGS. 27A and 27B, FIGS. 28A and 28B, FIGS. 29A and 29B, FIGS. 30A and 30B, and FIG. 31 are diagrams showing the operation pattern according to the embodiment step by step. As shown in FIG. 27A, a changeover feeding path 321 for feeding sheets of paper to the feeding path 110 from the sheet feeding shelf 52*a* and a changeover feeding path 322 for feeding sheets of paper to the bypass path 310 from the sheet feeding shelf 52*b* are provided in the embodiment. This structure can allow an arbitrary combination of the sheet feeding shelves and the feeding paths to be selected. That is, sheets of paper can be supplied to the bypass path 310 and also to the feeding path 110 from the sheet feeding shelf 52*a*. Likewise, sheets of paper can be supplied to the feeding path 110 and also to the bypass path 310 from the sheet feeding shelf 52*b*.

In the operation pattern shown in FIGS. 27 to 31, color print sheets 22 are supplied to the sheet feeding shelf 52*a* and are supplied to the feeding path 110, while monochromatic print sheets 21*a* to 21*d* are supplied to the sheet feeding shelf 52*b* and are supplied to the bypass path 310. The other structure of the operation pattern of the embodiment is the same as the structure of the first operation pattern of the third embodiment.

According to the embodiment, the provision of the changeover feeding paths 321 and 322 in the prebinding apparatus allows sheets of paper which need the SCC step to be supplied to the feeding path 110 and sheets of paper which do not need the SCC step to be supplied to the bypass path 310, regardless of the structures of the sheet feeder and the image forming apparatus. This can widen the range of selection of the sheet feeder and the image forming apparatus. The other effects of the embodiment are the same as those of the third embodiment.

Although the bypass section is illustrated as extending above the SCC step means in the second to fourth embodiments, the invention is not limited to this particular mode, and the bypass section may bypass the SCC step means on the same plane. Although the bypass section and the SCC step means are illustrated to be housed in a single casing, the invention is not limited to this particular case, and those two means may be housed in separate casings. Further, while feed-roller type feeding section is illustrated as the feeding section in the conveying section, the invention is not limited to this particular structure. For example, belt type feeding section or a handler or so with a suction head for sucking binding sheets of paper may be used as well.

What is claimed is:

1. A bookbinding machine comprising:

a prebinding apparatus which cuts edge portions of at least some of plural sheets of paper continuously supplied thereto, said prebinding apparatus comprising:

a feeding section which feeds said supplied sheets of paper one by one;

a cutting section which cuts edge portions of those sheets of paper which are on a feeding path for said sheets of paper formed by said feeding section; and a control section which sorts said supplied sheets of paper into cutting-needed sheets of paper whose edge portions should be cut and non-cutting-needed sheets of paper whose edge portions need not be cut, and controls said feeding section and said cutting section based on a result of that sorting in such a way as to cut said edge portions of said cutting-needed sheets of paper and not to cut said edge portions of said non-cutting-needed sheets of paper; and a bookbinding apparatus which is continuously supplied with said plural sheets of paper from said prebinding apparatus by said feeding section, stacks said plural sheets of paper by a predetermined number, and binds and folds said plural sheets of paper.

2. The bookbinding machine according to claim 1, wherein said cutting section comprises a feeding-directional cutting section which cuts said cutting-needed sheets of paper in a direction parallel to a feeding direction to cut edge portions of said cutting-needed sheets of paper which extend in said feeding direction.

3. The bookbinding machine according to claim 1, wherein said cutting section comprises an orthogonal-to-feeding-direction cutting section which cuts said cutting-needed sheets of paper in a direction orthogonal to a feeding direction to cut edge portions of said cutting-needed sheets of paper which extend in said direction orthogonal to said feeding direction.

4. The bookbinding machine according to claim 1, wherein said prebinding apparatus further comprises:

a bypass section which causes said non-cutting-needed sheets of paper to bypass said cutting section and feeds said non-cutting-needed sheets of paper toward said bookbinding apparatus; and a feeding-path changing section which feeds said cutting-needed sheets of paper to said cutting section and feeds said non-cutting-needed sheets of paper to said bypass section based on said result of sorting done by said control section.

5. The bookbinding machine according to claim 1, wherein said prebinding apparatus further comprises a creasing section which forms creases at those portions of said cutting-needed sheets of paper which are to be folded by said bookbinding apparatus.

6. The bookbinding machine according to claim 1, wherein said control section performs said sorting based on information input beforehand.

7. The bookbinding machine according to claim 1, further comprising a sheet feeder which continuously feeds said sheets of paper to said prebinding apparatus.

8. The bookbinding machine according to claim 7, wherein said sheet feeder comprises:

a first sheet feeding shelf where said cutting-needed sheets of paper are to be supplied; and a second sheet feeding shelf where said non-cutting-needed sheets of paper are to be supplied, and said sheet feeder continuously feeds said cutting-needed sheets of paper and said non-cutting-needed sheets of paper to said prebinding apparatus in a predetermined order.

9. The bookbinding machine according to claim 1, further comprising an image forming apparatus which forms images on said sheets of paper and continuously feeds those image-formed sheets of paper to said prebinding apparatus.

10. The bookbinding machine according to claim 9, wherein said image forming apparatus comprises:

a first sheet feeding shelf where said cutting-needed sheets of paper on which images have not been formed yet are to be supplied; and a second sheet feeding shelf where said non-cutting-needed sheets of paper on which images have not been formed yet are to be supplied, and said image forming apparatus forms images on said cutting-needed sheets of paper and said non-cutting-needed sheets of paper and continuously feeds said cutting-needed sheets of paper and said non-cutting-needed sheets of paper to said prebinding apparatus, in a predetermined order.

11. A prebinding apparatus connected to an input side of a bookbinding apparatus which is continuously supplied with plural sheets of paper, stacks said plural sheets of paper by a predetermined number, and binds and folds said plural sheets of paper, continuously supplies said plural sheets of paper to said bookbinding apparatus, said prebinding apparatus comprising:

a feeding section which feeds supplied sheets of paper to said bookbinding apparatus one by one;

a cutting section which cuts edge portions of those sheets of paper which are on a feeding path for said sheets of paper formed by said feeding section; and a control section which sorts said supplied sheets of paper into cutting-needed sheets of paper whose edge portions should be cut and non-cutting-needed sheets of paper whose edge portions need not be cut, and controls said feeding section and said cutting section based on a result of that sorting in such a way as to cut said edge portions of said cutting-needed sheets of paper and not to cut said edge portions of said non-cutting-needed sheets of paper.

12. The prebinding apparatus according to claim 11, wherein said cutting section comprises a feeding-directional cutting section which cuts said cutting-needed sheets of paper in a direction parallel to a feeding direction to cut edge portions of said cutting-needed sheets of paper which extend in said feeding direction.

13. The prebinding apparatus according to claim 11, wherein said cutting section comprises an orthogonal-to-feeding-direction cutting section which cuts said cutting-needed sheets of paper in a direction orthogonal to a feeding direction to cut edge portions of said cutting-needed sheets of paper which extend in said direction orthogonal to said feeding direction.

14. The prebinding apparatus according to claim 11, further comprising:

a bypass section which causes said non-cutting-needed sheets of paper to bypass said cutting section and feeds said non-cutting-needed sheets of paper toward said bookbinding apparatus; and a feeding-path changing section which feeds said cutting-needed sheets of paper to said cutting section and feeds said non-cutting-needed sheets of paper to said bypass section based on said result of sorting done by said control section.

15. The prebinding apparatus according to claim 11, further comprising a creasing section which forms creases at those portions of said cutting-needed sheets of paper which are to be folded by said bookbinding apparatus.

16. The prebinding apparatus according to claim 11, wherein said control section performs said sorting based on information input beforehand.

* * * * *